US010021739B2

(12) United States Patent
Kiernan et al.

(10) Patent No.: US 10,021,739 B2
(45) Date of Patent: Jul. 10, 2018

(54) TRIMMABLE HEATER

(71) Applicant: MKS INSTRUMENTS, INC., Andover, MA (US)

(72) Inventors: Jeffrey D. Kiernan, Frederick, CO (US); Karl Hausmann, Boulder, CO (US); Paul Dozoretz, Lafayette, CO (US)

(73) Assignee: MKS Instruments, Inc., Andover, MA (US)

( * ) Notice: Subject to any disclaimer, the term of this patent is extended or adjusted under 35 U.S.C. 154(b) by 315 days.

(21) Appl. No.: 14/794,550

(22) Filed: Jul. 8, 2015

(65) Prior Publication Data

US 2017/0013678 A1 Jan. 12, 2017

(51) Int. Cl.
*H05B 3/58* (2006.01)
*H05B 3/34* (2006.01)
(Continued)

(52) U.S. Cl.
CPC ..... *H05B 3/34* (2013.01); *H05B 3/36* (2013.01); *H05B 3/46* (2013.01);
(Continued)

(58) Field of Classification Search
CPC . H05B 3/34; H05B 3/28; H05B 3/342; H05B 3/36; H05B 3/46; H05B 2203/026; H05B 2203/032; H05B 2203/002; H05B 2203/036; H05B 2203/005; H05B 2203/013; H05B 2203/017;
(Continued)

(56) References Cited

U.S. PATENT DOCUMENTS 3,675,046 A 7/1972 Harkenrider et al.
3,679,871 A 7/1972 Evalds
(Continued)

FOREIGN PATENT DOCUMENTS

DE 4416798 11/1995
EP 1869535 B1 11/2010
(Continued)

OTHER PUBLICATIONS

International Search Report submitted in PCT Application Serial No. PCT/US2016/039211, dated Oct. 13, 2016.
(Continued)

*Primary Examiner* — Shawntina Fuqua
(74) *Attorney, Agent, or Firm* — James R. Young; Cochran Freund & Young LLC

(57) ABSTRACT

A trimmable heater mat has a plurality of heater mat segments that together comprise a length of the heater mat. Each of the heater mat segments has a segment heater element connected to a power bus for generating heat. One or more of the heater mat segments can be severed from the others and removed from the heater mat to trim the length of the heater mat to a desired length. Heater mat segment boundary indicia on the heater mat indicate locations where one of the heater mat segments can be severed from the other remaining heater mat segments of the heater mat without interfering with the segment heater elements of the remaining heater mat segments or with the connections of the remaining segment heater elements to the power bus.

33 Claims, 21 Drawing Sheets

(51) Int. Cl.
*H05B 3/36* (2006.01)
*H05B 3/46* (2006.01)

(52) U.S. Cl.
CPC .. *H05B 2203/003* (2013.01); *H05B 2203/013* (2013.01); *H05B 2203/016* (2013.01); *H05B 2203/017* (2013.01); *H05B 2203/021* (2013.01); *H05B 2203/022* (2013.01)

(58) Field of Classification Search
CPC ..... H05B 2203/003; H05B 2203/021; H05B 2203/022; H05B 2203/016; F24D 13/024
See application file for complete search history.

(56) References Cited

U.S. PATENT DOCUMENTS

| | | | |
|---|---|---|---|
| 3,689,886 | A | 9/1972 | Durkee |
| 3,752,956 | A | 8/1973 | Cahill et al. |
| 3,789,190 | A | 1/1974 | Orosy et al. |
| 3,796,977 | A | 3/1974 | Elliott et al. |
| 3,869,597 | A | 3/1975 | Strange |
| 4,086,466 | A | 4/1978 | Scharlack |
| 4,237,369 | A | 12/1980 | Jones |
| 4,268,818 | A | 5/1981 | Davis et al. |
| 4,290,056 | A | 9/1981 | Chow |
| 4,329,569 | A | 5/1982 | Hjortsberg et al. |
| 4,400,688 | A | 8/1983 | Johnston et al. |
| 4,418,333 | A | 11/1983 | Schwarzbach et al. |
| 4,446,462 | A | 5/1984 | Ouellette et al. |
| 4,474,825 | A | 10/1984 | Schmidt |
| 4,506,146 | A | 3/1985 | Rice et al. |
| 4,507,546 | A | 3/1985 | Fortune et al. |
| 4,540,875 | A | 9/1985 | Buttolph, III |
| 5,714,738 | A | 2/1998 | Hauschulz et al. |
| 5,790,354 | A | 8/1998 | Altiti et al. |
| 6,894,254 | B2 | 5/2005 | Hauschulz |
| 7,932,480 | B2 | 4/2011 | Gu et al. |
| 2001/0045424 | A1 | 11/2001 | Cooper |
| 2002/0008101 | A1 | 1/2002 | Hauschulz |
| 2007/0235440 | A1 | 10/2007 | Gu et al. |
| 2008/0083743 | A1* | 4/2008 | Wheeler ..... A41D 31/0038 219/538 |
| 2010/0288752 | A1 | 11/2010 | Lee et al. |
| 2013/0034343 | A1* | 2/2013 | Gilad ..... F24D 13/024 392/432 |

FOREIGN PATENT DOCUMENTS

| | | | |
|---|---|---|---|
| KR | 101439989 | | 9/2014 |
| WO | 9703540 | A2 | 1/1997 |
| WO | 2007092474 | A1 | 8/2007 |

OTHER PUBLICATIONS

MKS Instruments, Inc.; Vacuum Technology Series 46 Heaters—Heater Jackets for Stainless Steel Tubing; Bulletin 8/12; MKS Vacuum Technology, Boulder, Colorado; MKS Global Headquarters, Andover, Massachusettes; 18 pages.

Briskheat; "Centipede Temperature Controllers"; 2009-2013; 3 pages (10-3 to 10-5); 12th Edition; accessed at http://www.briskheat.com/centtemperaturecontrol.aspx.

Briskheat; Centipede 2 Temperature Control System; 2009-2013; 6 pages (p. 82-86); 12th Edition; accessed at http://www.briskheat.com/c-118-new-centipede-2-temperature-control-system.aspx.

Electro Plastics, Inc.; "STEP Warmfloor Installation Manual"; Aug. 2012, 28 pages.

* cited by examiner

AMENDED

TRIMMABLE HEATER

BACKGROUND

Technical Field of the Invention

The present invention is related to heaters, including heater assemblies for heating pipes, fittings, and other piping system components.

State of the Prior Art

Many vacuum, process, transport, and other systems used in industry for conducting or moving various gaseous, liquid, or solid materials from one point to another include pipes, valves, and other pipe system components of various lengths, sizes, and shapes that have to be heated to maintain the pipes and/or materials in the pipes within certain temperature ranges. Pipe heaters for heating pipes for these and other purposes are well known to persons skilled in the art and have ranged from simple resistive wires and tape wrapped around the pipes to more sophisticated, insulated pipe heaters, such as those described in U.S. Pat. No. 5,714,738 (Hauschultz et al.), as well as many such heater products that are available commercially.

The foregoing examples of the related art and limitations related therewith are intended to be illustrative and not exclusive. Other limitations of the related art and other examples of related art will become apparent to those of skill in the art upon a reading of the specification and a study of the drawings.

SUMMARY

The following embodiments and aspects thereof are described and illustrated in conjunction with systems, tools, and methods which are meant to be examples and illustrative, not limiting in scope. In various embodiments and implementations, one or more problems have been reduced or eliminated, while other embodiments are directed to other improvements and benefits.

In one aspect, a trimmable heater apparatus comprises: (i) a heater mat which extends along a longitudinal length and comprises a plurality of heater mat segments, wherein each of the heater mat segments extends along a respective portion of the longitudinal length of the heater mat, and wherein each of the heater mat segments comprises a segment heater element, and wherein the respective segment heater elements are separated longitudinally from each other by respective trimmable distances; (ii) a power bus comprising a first power conductor and a second power conductor which span all of the trimmable distances between the segment heater elements to extend in juxtaposed relation with to at least a portion of each of the heater mat segments, wherein each of the respective heater elements is connected electrically to the first and second power conductors at respective segment connection locations in the power bus that are in juxtaposed relation with the respective heater mat segments which comprise the respective segment heater elements such that any two of the plurality of heater mat segments are severable from each other in the trimmable distance between the segment heater elements of said two heater mat segments in a manner that does not affect the electrical connections of the segment heater element in at least one of the two heater mat segments to the first and second power conductors in the power bus.

In one embodiment, a trimmable heater apparatus includes heater mat segment boundary indicia on a surface of the heater mat in each of the trimmable distances, wherein the heater mat segment boundary indicia mark severable locations on the heater mat in the trimmable distances.

In one embodiment, the trimmable heater apparatus includes bus trim location indicia on the power bus between the respective segment connection locations in the power bus.

In one embodiment, the bus trim location indicia for each mat segment are longitudinally offset from the heater mat segment boundary indicia for that mat segment.

In one embodiment, the trimmable heater apparatus includes a cover sheet overlaying the heater mat segments and the power bus.

In one embodiment, the trimmable heater apparatus includes a cover sheet overlaying the heater mat segments and the power bus, wherein the cover sheet is peelable away from the heater mat segments to reveal the heater mat segment boundary indicia.

In one embodiment, the trimmable heater apparatus includes a cover sheet overlaying the heater mat segments and the power bus, wherein the cover sheet is peelable away from the power bus to reveal the bus trim location indicia.

In one embodiment, the trimmable heater apparatus has a heater mat that includes a thermal insulation layer positioned between the heater mat and the cover sheet.

In one embodiment, the trimmable heater apparatus has a heater mat that includes a thermal insulation layer positioned between the heater mat and the cover sheet, and the heater mat segment boundary indicia is on an exterior surface of the thermal insulation layer.

In one embodiment, the trimmable heater apparatus has a power bus that is positioned between the thermal insulation layer and the cover sheet.

In one embodiment, the trimmable heater apparatus includes a power bus, which is positioned between the segment heater elements and the thermal insulation layer.

In one embodiment, the heater mat of a trimmable heater includes a heater substrate on which the segment heater elements are positioned.

In one embodiment, the trimmable heater apparatus includes segment heater elements that are sandwiched between the heater substrate and a heater superstrate.

In one embodiment, the thermal insulation layer is positioned between the superstrate and the cover sheet.

In one embodiment of a trimmable heater apparatus, a heater substrate on which segment heater elements are positioned comprises a thin film dielectric material.

In one embodiment the heater mat comprises both the segment heater elements and the first and second power conductors.

In one embodiment the segment heater elements are placed on a heater substrate sheet.

In one embodiment the first and second power conductors of the power bus are placed on an interstitial isolation layer which is placed on the segment heater elements on the heater substrate sheet.

In another embodiment the first and second power conductors of the power bus are placed on the substrate sheet together with the segment heater elements.

Another aspect of the invention includes a method of constructing a heater appliance, which includes using a heater mat that comprises an assembly of a plurality of heater mat segments that have a trimmable distance between juxtaposed segment heater elements, connecting each respective one of the segment heater elements in electrical parallel relation to first and second power conductors in a power bus at respective segment connection locations of the power bus that are in juxtaposed relation with the respective heater mat segments in which such segment heater elements are positioned, providing respective heater mat segment boundary indicia on the heater mat at each of the respective trimmable distances to mark severable locations at which any two of the plurality of heater mat segments are severable from each other in a manner that does not affect the electrical connections of the segment heater element in at least one of the two heater mat segments to the first and second power conductors in the power bus.

Another aspect of the invention includes providing respective bus trim location indicia on the power bus between the respective segment connection locations of the power bus to mark severable bus locations at which the power bus is severable along with a respective heater mat segment in a manner that does not affect the electrical connection of a juxtaposed heater mat segment from which the respective heater mat segment is severable.

Another aspect of the invention includes positioning the bus trim location indicia for each respective heater mat segment in a longitudinally offset relation to the respective heater mat segment boundary indicia.

Another aspect of the invention includes placing a displaceable cover sheet over the heater mat and over the power bus in a displaceable manner which exposes the heater mat segment boundary indicia and the bus trim location indicia.

Another aspect of the invention includes placing a thermal insulation layer between the segment heater elements and the power bus.

Another aspect of the invention includes placing the plurality of segment heater elements on a thin film dielectric material.

Another aspect of the invention includes forming the plurality of segment heater elements along with additional segment heater elements on a sheet of the thin film dielectric material.

Another aspect of the invention includes cutting a portion of the sheet of the thin film dielectric material on which the plurality of segment heater elements are formed to separate that portion of the sheet of the thin film dielectric material from other portions of the sheet of the thin film dielectric material on which the additional segment heater elements are formed.

In another embodiment, a method of fitting a heater on an item to be heated comprises: (i) determining a length of the item to be heated; (ii) determining how many segments of the heater mat are required to span the length of the item to be heated; (iii) locating a specific indication on the heater mat that marks a location on the heater mat where a segment of the heater mat, which is not required for the heater mat to span the length of the item to be heated, is severable from another segment of the heater mat, which is required to span the length of the item to be heated, without affecting an electrical connection of a power bus to a heater element in the segment of the heater mat that is required to span the length of the item to be heated; and (iv) at the specific indication, severing the segment of the heater mat that is not required to span the length of the item to be heated from the segment of the heater mat that is required to span the length of the item to be heated.

Another embodiment includes severing the power bus at a location that does not affect the electrical connection of the power bus to the heater element in the segment of the heater mat that is required to span the length of the item to be heated.

Another embodiment includes displacing a cover sheet that covers the heater mat and the power bus enough to expose the specific indication and thereby to facilitate the severing, at the specific indication, of the segment of the heater mat that is not required to span the length of the item to be heated from the segment of the heater mat that is required to span the length of the item to be heated.

Another embodiment includes replacing the cover sheet on the segment of the heater mat that is required to span the length of the item to be heated after the severing of the segment of the heater mat that is not required to span the length of the item to be heated from the segment of the heater mat that is required to span the length of the item to be heated.

In addition to the example aspects, embodiments, and implementations described above, further aspects, embodiments, and implementations will become apparent to persons skilled in the art after becoming familiar with the drawings and study of the following descriptions.

BRIEF DESCRIPTION OF THE DRAWINGS

The accompanying drawings, which are incorporated herein and form a part of the specification, illustrate some, but not the only or exclusive, example embodiments and/or features. It is intended that the embodiments and figures disclosed herein are to be considered illustrative rather than limiting. In the drawings.

DETAILED DESCRIPTIONS OF EXAMPLE EMBODIMENTS

Figure 1:
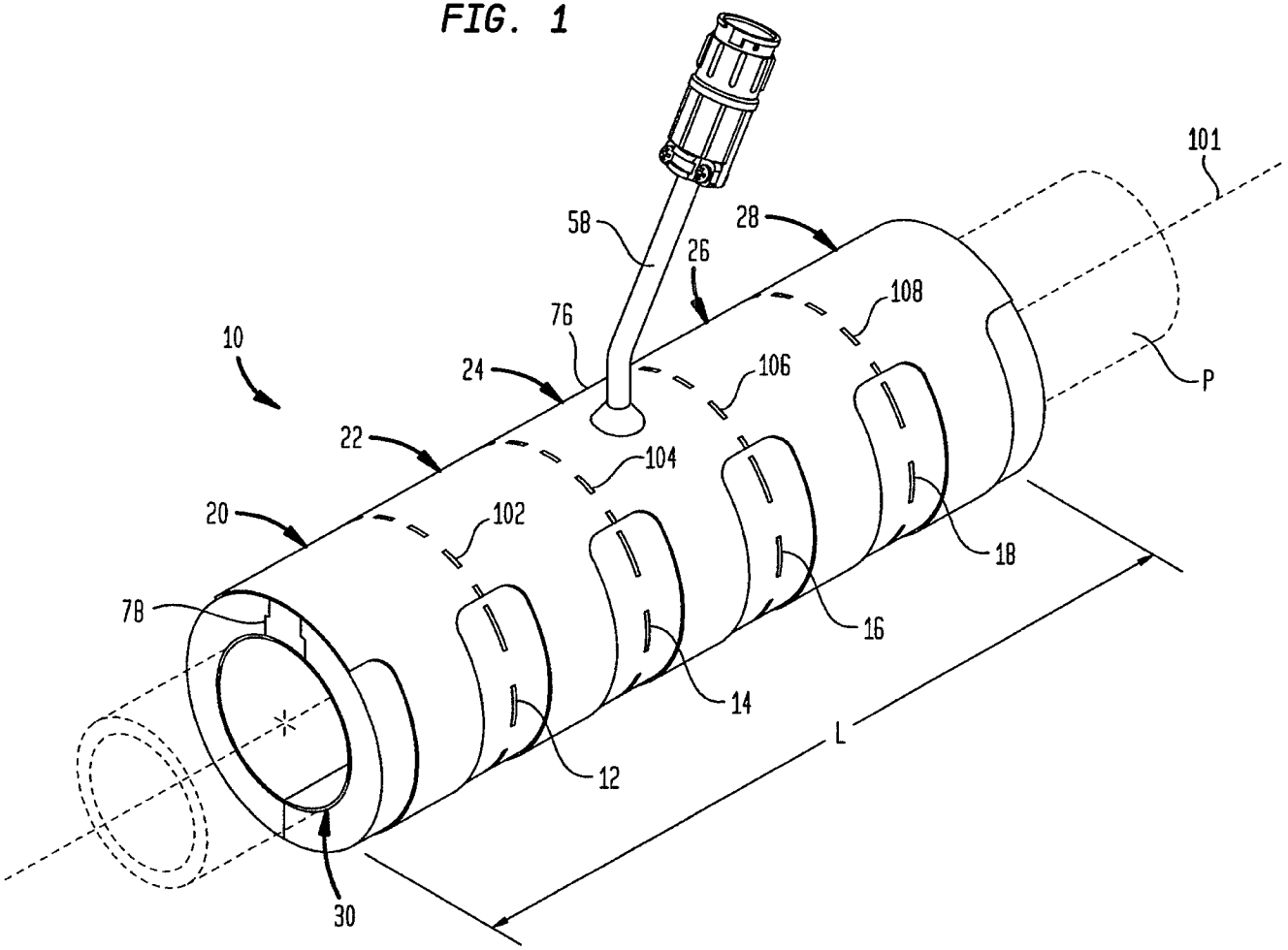
FIG. 1 is an isometric view of an example trimmable heater appliance, which is illustrated for example as mounted on an object to be heated shown in phantom lines, and which has a heater mat comprising a plurality of heater mat segments that are severable from each other at locations marked by indicia.
Figure 2:
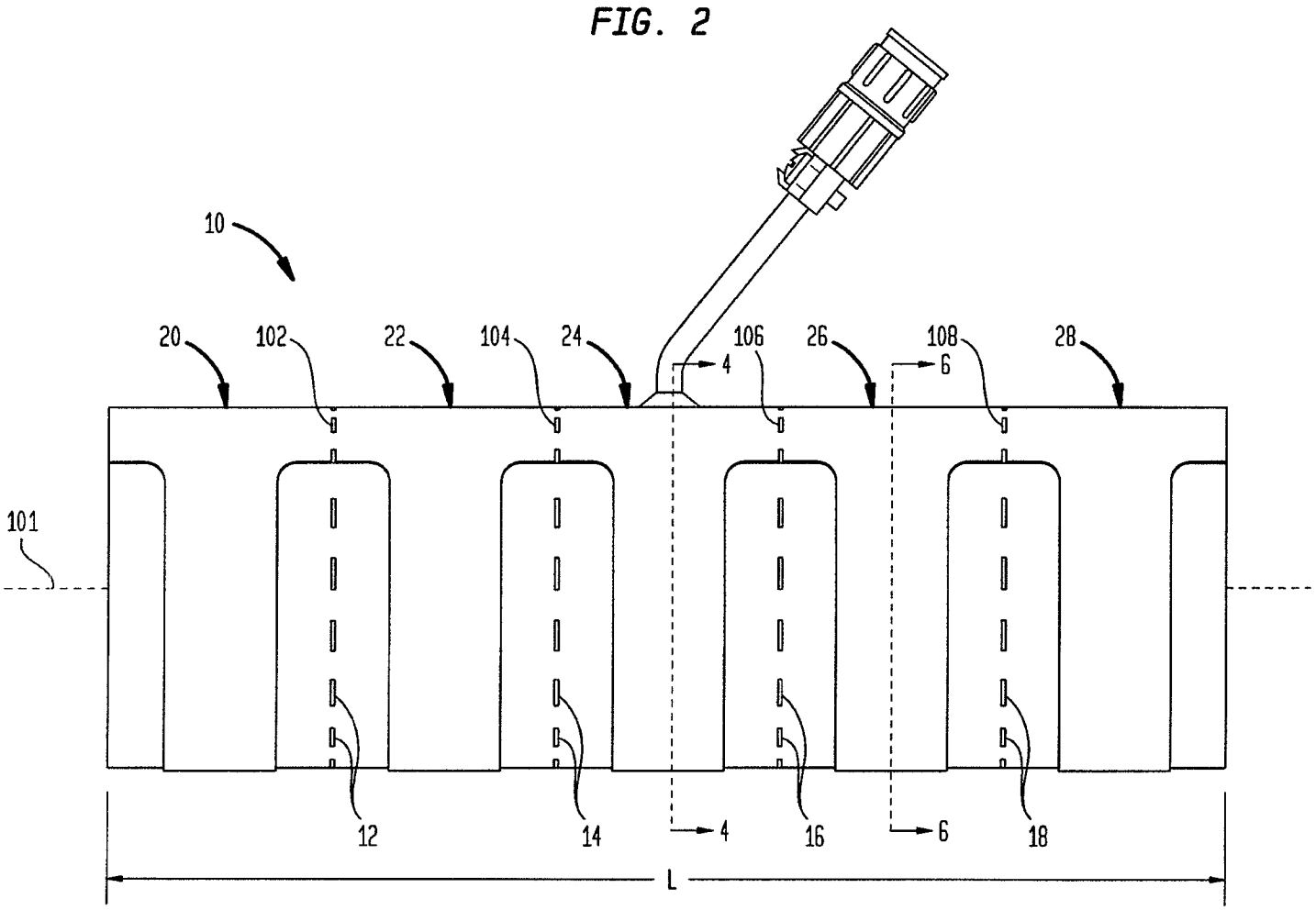
FIG. 2 is a side elevation view of the example trimmable heater appliance in FIG. 1.
Figure 4:
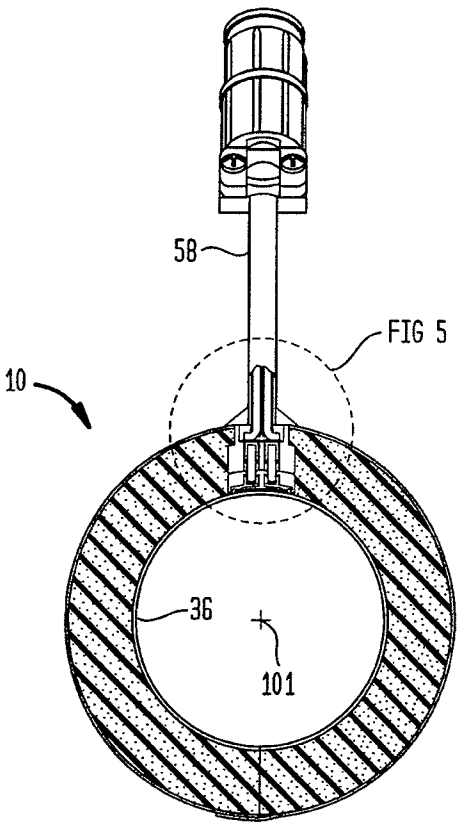
FIG. 4 is a cross-section view of the example heater appliance taken along section plane 4-4 in FIG. 2.
Figure 3:
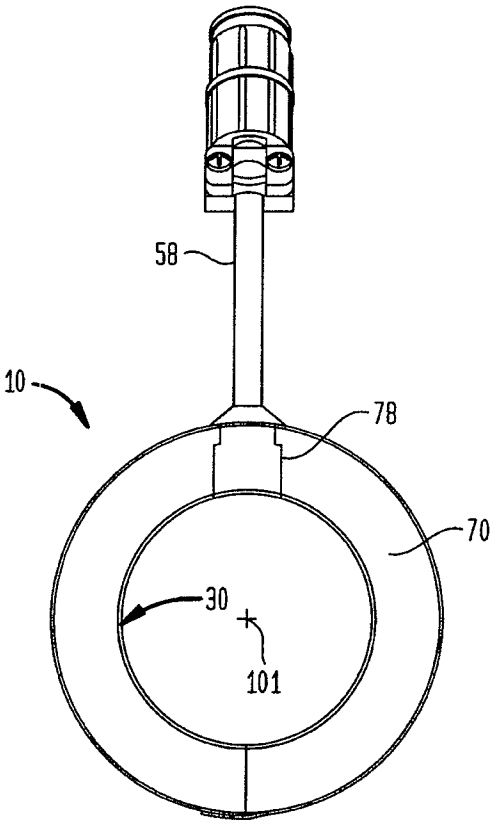
FIG. 3 is an end elevation view of the example trimmable heater appliance in FIG. 1.

An example trimmable heater appliance 10 is illustrated in FIG. 1 as mounted on an object to be heated, such as a pipe P, shown in phantom lines. As shown in FIGS. 1 and 2, the example trimmable heater appliance 10 has heater mat segment boundary indicia, e.g., marks 12, 14, 16, 18, which indicate locations on the trimmable heater appliance 10 where the trimmable heater appliance 10 can be cut or otherwise severed to separate one or more segments of the trimmable heater appliance 10, e.g., heater appliance segments 20, 22, 24, 26, 28, from one or more other ones of the heater appliance segments 20, 22, 24, 26, 28, as illustrated, for example in FIG. 12, without affecting electrical connections of individual segment heater elements (described below) in the remaining heater appliance segments to a power source connection, for example to the power cord 58 or to the power bus 52 (e.g., power conductors 54, 56). The heater appliance segment that has the power cord 58 is sometimes referred to in this description as the primary heater appliance segment, and the other heater appliance segments are sometimes referred to as the secondary heater appliance segments or as the trimmable heater appliance segments. In the example trimmable heater appliance 10, the middle heater appliance segment 24 has the power cord 58 this is the primary heater appliance segment, and the other heater appliance segments 20, 22, 26, 28 in the example trimmable heater appliance 10 do not have the power cord 58 and are the secondary or trimmable heater appliance segments. However, any of the heater appliance segments 20, 22, 24, 26, 28 could have the power cord 58, thus could be the primary heater appliance segment, and the others would be the secondary or trimmable heater appliance segments. Also, while the example trimmable heater appliance 10 is shown in FIGS. 1 and 2 with five trimmable or severable heater appliance segments 20, 22, 24, 26, 28, such a trimmable heater appliance 10 can be made with any number of trimmable or severable heater appliance segments in any desired length or lengths.

Each of the heater appliance segments 20, 22, 24, 26, 28 has an individual segment heating element 42, 44, 46, 48, 50 (see FIG. 10) connected in electrical parallel to a power bus 52, and the power bus 52 is electrically connected to the power source connection, e.g., to the power cord 58, as will be explained in more detail below. Accordingly, each of the segment heating elements 42, 44, 46, 48, 50 can be powered by connecting the power source connection, e.g., the power cord 58, to a source of electric power (not shown). Consequently, any of the secondary heater appliance segments, e.g., the secondary heater appliance segments 20, 22, 26, 28 in the example trimmable heater appliance 10, can be cut away from any other ones of the secondary heater appliance segments or from the primary heater appliance segment 24, and the remaining primary heater appliance segment 24 as well as any secondary heater appliance segment that is still connected to the primary heater appliance segment 24 will continue to be functional for producing heat when the power cord 58 is connected electrically to a source of electric power (not shown). Therefore, when the trimmable heater appliance 10 is too long to fit neatly and securely on an object to be heated, one or more of the heater appliance segments 20, 22, 24, 26, 28 with its respective segment heater element 42, 44, 46, 48, 50 (FIG. 10) can be severed from one or more other ones of the heater appliance segments 20, 22, 24, 26, 28 to trim the heater appliance 10 to a desired or appropriate length to fit neatly or securely on the object. The heater mat segment boundary indicia 12, 14, 16, 18 in FIGS. 1 and 2 are illustrated as marks on a visible surface of the heater appliance 10, but they can be provided in any convenient form, including, for example, slots, bumps, grooves, notches, weakened tear line, or other instrumentality.

Figure 9:
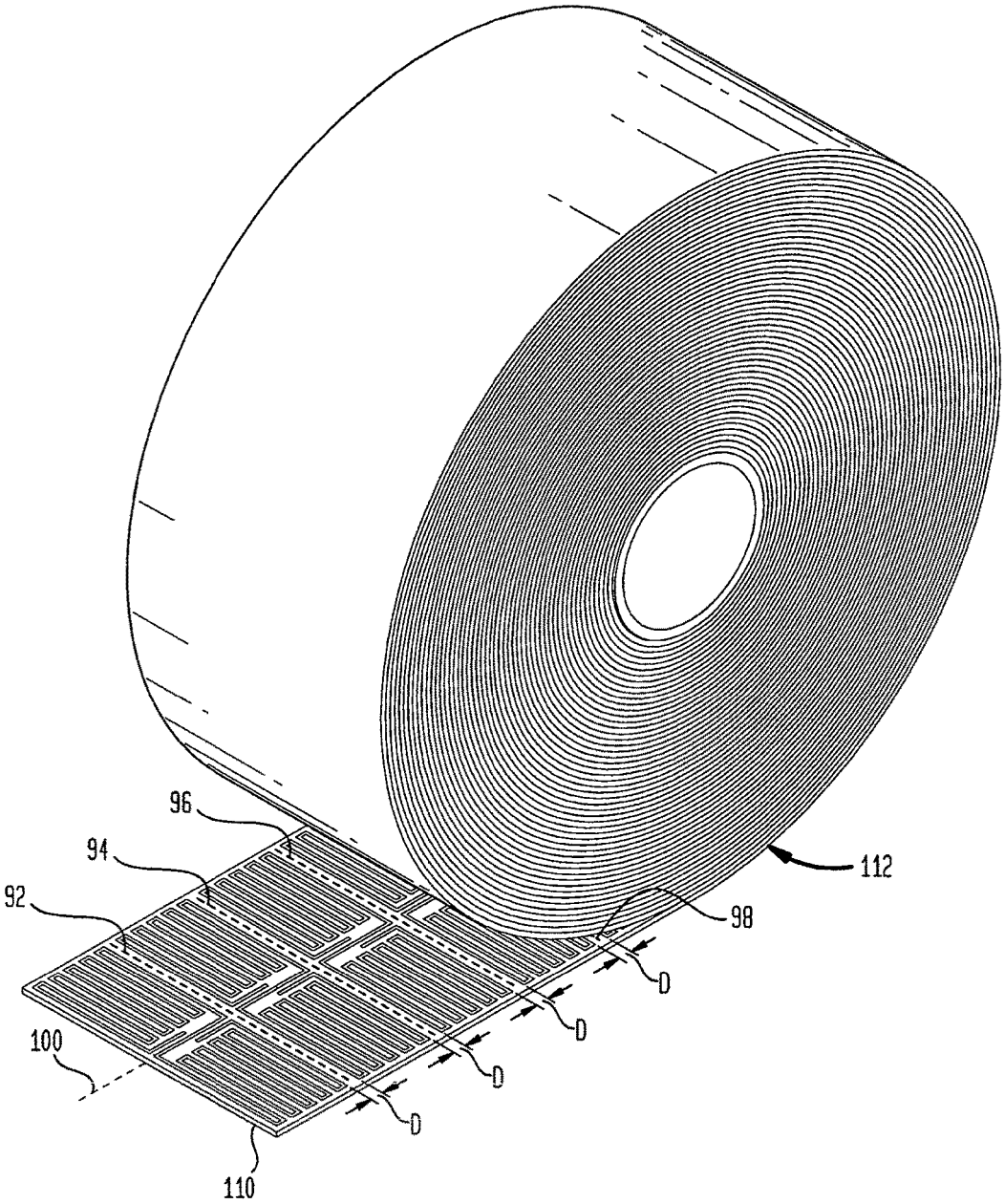
FIG. 9 is an isometric view of example heater mat segments formed in a roll from which a desired number of heater mat segments can be taken to form a heater mat in a trimmable heater appliance of the type illustrated in FIG. 1.
Figure 10:
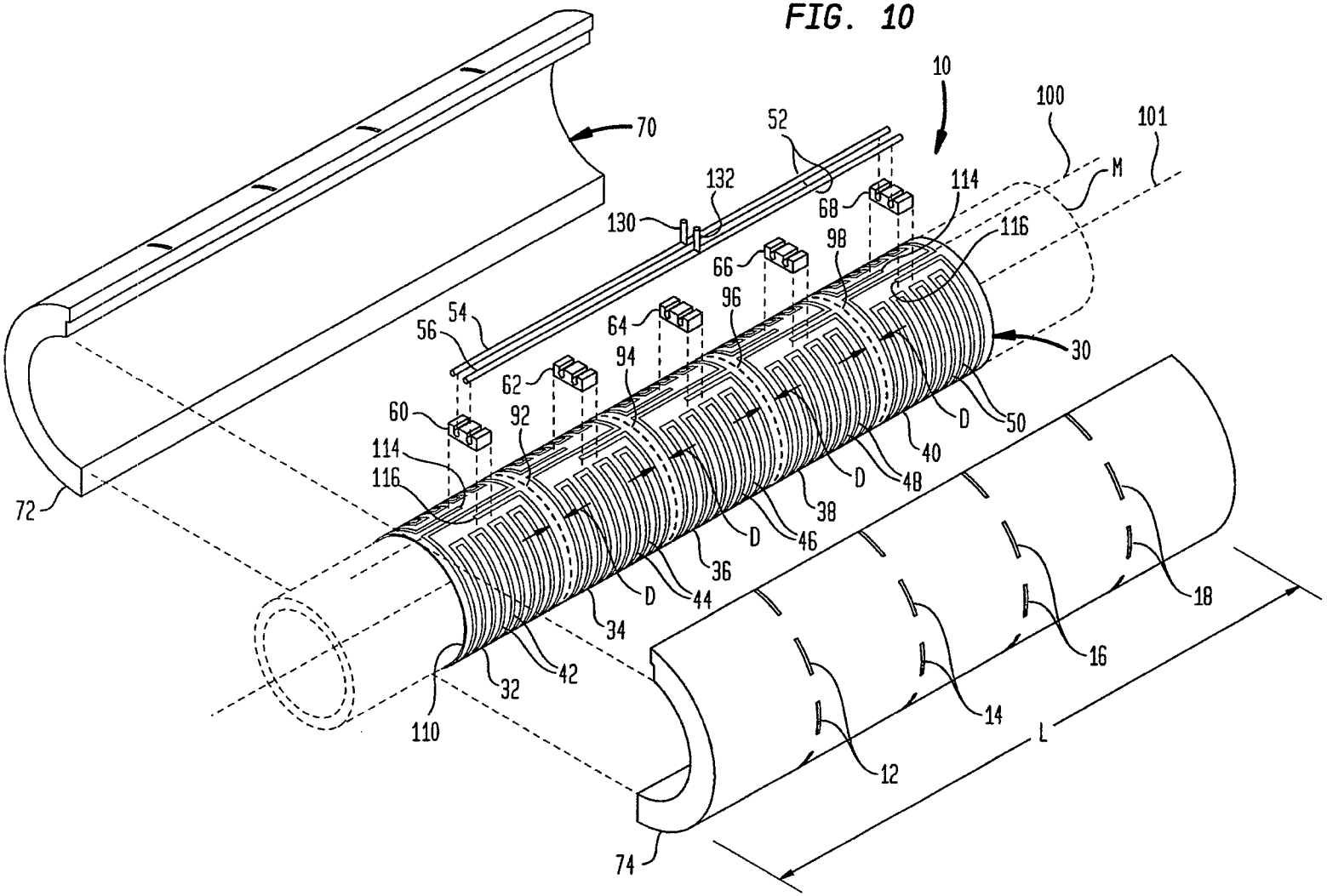
FIG. 10 is an isometric exploded view of example components of the example trimmable heater appliance in FIG. 1.
Figure 11:
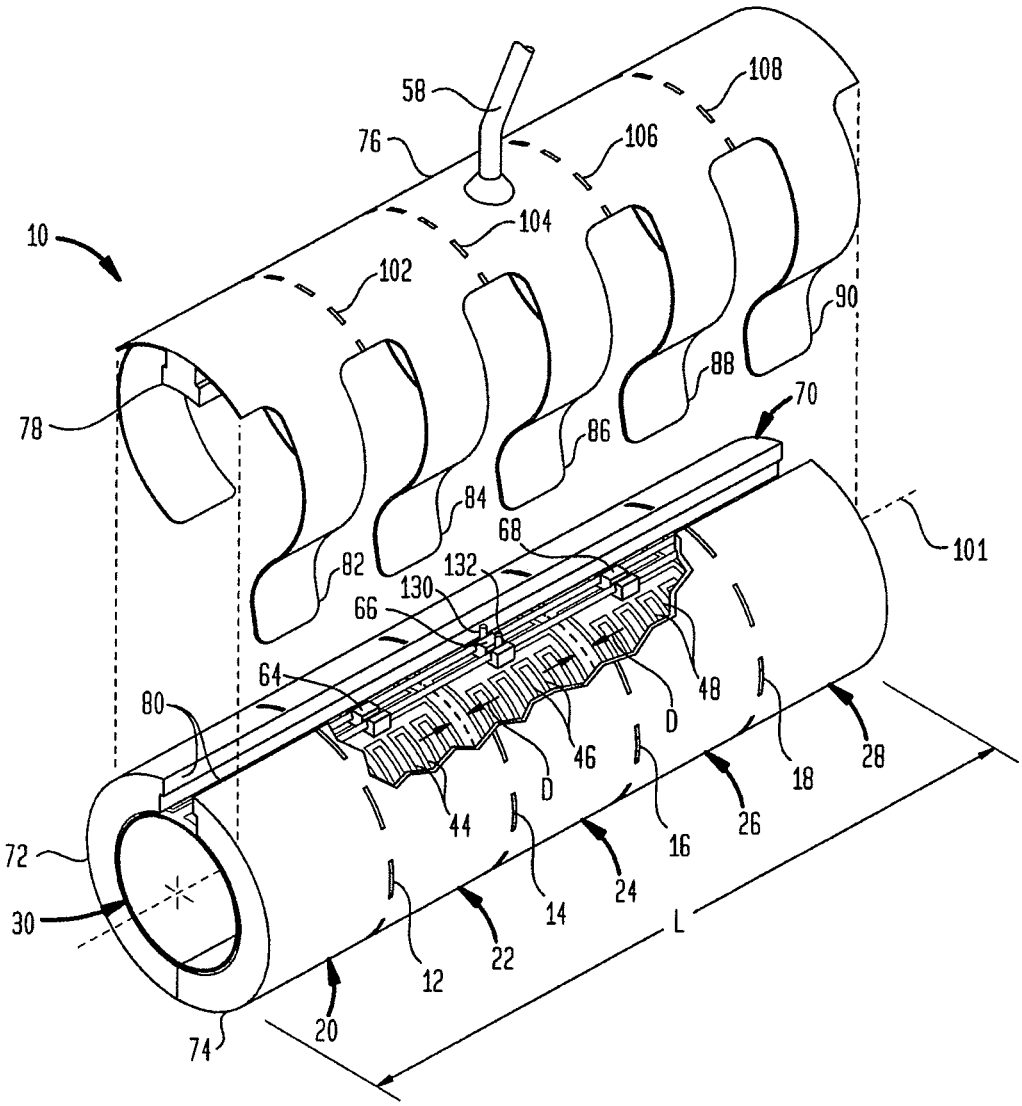
FIG. 11 is an isometric view of the example components in FIG. 10 assembled together to form an example trimmable heater appliance of the type illustrated in FIG. 1 along with a cover sheet positioned in alignment for mounting on the example trimmable heater appliance, and wherein a portion of the thermal insulation layer of the trimmable heater appliance cut away to reveal the heater mat and power bus.

Referring now primarily to FIGS. 10 and 11 with secondary reference to FIGS. 1-7, the example trimmable heater appliance 10 has a heater mat 30, which has a plurality of heater mat segments, e.g., heater mat segments 32, 34, 36, 38, 40, extending along a longitudinal length L. Longitudinal as used in this description refers to the dimension of the example trimmable heater appliance 10 in which the example heater appliance 10 is trimmable, i.e., can be shortened by cutting away or otherwise removing one or more of the secondary heater mat segments from the rest of the heater mat segments as explained above. Accordingly, for example, the longitudinal axis 100 of the heater mat 30 shown in FIGS. 8-13 extends through the plurality of heater mat segments 32, 34, 36, 38, 40. In FIGS. 1-4 and 10-12, where the example trimmable heater appliance 10 is illustrated as having a cylindrical shape that defines a heater appliance longitudinal axis 101, the longitudinal length L and the heater mat longitudinal axis 100 extend in the direction of, and parallel to, the cylindrical heater appliance longitudinal axis 101.

Each of the heater mat segments 32, 34, 36, 38, 40 has a segment heater element, e.g., segment heater elements 42, 44, 46, 48, 50, respectively, which generates heat when electric power is applied to it. Generally, each segment heater element may comprise an electrically resistive wire, ribbon, trace, sheet, mesh, or other resistive material that generates heat when a voltage is applied across it and a current flows through it, although other kinds of heat generating devices could be used for the segment heater elements. For example, any of a variety of known electrically resistive metals or metal alloys can be used for the segment heater elements 42, 44, 46, 48, 50, including, but not limited to, nickel-chromium, iron-chromium-aluminum, or copper-nickel. Other example electrically resistive materials may include, but are not limited to, ceramics and polymer matrices loaded with conductive particles.

Each of the example individual segment heater elements 42, 44, 46, 48, 50 is connected to an electric power bus 52, which has at least two power conductors, e.g., a first power conductor 54 and second power conductor 56, for conducting electric power to the individual segment heater elements 42, 44, 46, 48, 50. The first power conductor 54 and the second power conductor 56 extend in juxtaposed relation with the segment heater elements 42, 44, 46, 48, 50 in each of the heater mat segments 32, 34, 36, 38, 40 so that electrical connection of the individual segment heater elements to the first and second power conductors 54, 56 of the power bus 52 are made at respective segment connection locations in the power bus 52 that are in juxtaposed relation with each of the respective heater mat segments 32, 34, 36, 38, 40. Such electrical connections of the individual segment heater elements 42, 44, 46, 48, 50 to the first and second power conductors 54, 56 at the respective segment connection locations in the power bus 52 can be made in any convenient manner, as will be discussed in more detail below, as long as such connections are made in a segment connection location where severance of one or more of the heater mat segments 32, 34, 36, 38, or 40 from one or more of the other heater mat segments 32, 34, 36, 38, 40 does not interfere with the electrical connections of the remaining heater mat segments 32, 34, 36, 38, or 40 to the first and second power conductors 54, 56 which are connected to the power cord 58 as will be explained in more detail below. The heater mat segments 32, 34, 36, 38, 40 are severable from each other in trimmable distances D (see FIGS. 8-10) between juxtaposed ones of the segment heater elements 42, 44, 46, 48, 50 of the respective heater mat segments 32, 34, 36, 38, 40 where no parts of the segment heater elements 42, 44, 46, 48, 50 that are necessary for production of heat by the segment heater elements 42, 44, 46, 48, 50 are located, as will be explained in more detail below. Each of the heater appliance segments 20, 22, 24, 26, 28 of the example trimmable heater appliance 10 comprises a respective one of the heater mat segments 32, 34, 36, 38, 40, which define the trimmable heater appliance segments 20, 22, 24, 26, 28 that are severable from one or more of the other heater appliance segments 20, 22, 24, 26, 28 in a manner that does not interfere with the electrical connections of the segment heater elements 42, 44, 46, 48, 50 in the remaining heater appliance segments 20, 22, 24, 26, 28 to the power bus 52, which is connected to the power cord 58 in the primary heater appliance segment as will also be explained in more detail below.

In the example trimmable heater appliance 10 in FIGS. 1-11, each of the segment heater elements 42, 44, 46, 48, 50 are electrically connected in parallel to the first and second power conductors 52, 54 of the electric power bus 52, although series electrical connections of segment heater elements to the electric power bus 52 would be possible. The parallel electrical connections of the individual segment heater elements 42, 44, 46, 48, 50 to the power conductors 54, 56 of the power bus 52 at the segment connection locations can be made in a variety of ways as would be understood by persons skilled in the art once they come to understand the principles of the inventions and apparatus described and shown in the drawings. One example of such electrical connections at the segment connection locations as illustrated in FIGS. 10 and 11 includes self-stripping tap connectors 60, 62, 64, 66, 68, which will be described in more detail below.

An optional thermal insulation layer 70 can be provided over the heater mat 30. In the example cylindrical shaped heater appliance 10 shown in FIGS. 1-11, the thermal insulation layer 70 is comprised of two half sections 72, 74 of thermal insulation that are sized and shaped to fit snugly over the heater mat 30, as best seen in FIGS. 10 and 11. A cover sheet 76 is positioned around the thermal insulation layer 70. The cover sheet 76 in the example heater appliance 10 includes a rib 78 that is sized and shaped to fill a gap 80 in the thermal insulation layer 70 and provides a substrate for mounting the electric power cord 58, as will be described in more detail below. Straps 82, 84, 86, 88, 90 are provided on the cover sheet 76 for fastening the cover sheet 76 around the thermal insulation layer 70. If the optional thermal insulation layer 70 is not provided, then the cover sheet 76 would be sized to fit directly around the heater mat 30, and the rib 78 would also be sized differently or just eliminated.

As mentioned above, each segment heater element 42, 44, 46, 48, 50 is contained within its respective heater mat segment 32, 34, 36, 38, 40, including the location of its respective electrical connection to the power bus 52. As mentioned above and best seen in FIG. 10 as well as in FIGS. 8 and 9, there is a trimmable distance D between juxtaposed ones of the segment heater elements 42, 44, 46, 48, 50 in the heater mat 30. None of the segment heater elements 42, 44, 46, 48, 50 and no electrically conductive parts of the segment heater elements 42, 44, 46, 48, 50 that have to conduct electricity in order for the segment heater elements 42, 44, 46, 48, 50 to generate heat extend into the trimmable distances D between juxtaposed segment heater elements 42, 44, 46, 48, 50. Therefore, any of the heater mat segments 32, 34, 36, 38, 40 can be trimmed or severed away from other ones of the heater mat segments 32, 34, 36, 38, 40 by cutting or otherwise separating them from each other in the trimmable distance D between the respective segment heater elements 42, 44, 46, 48, 50 without cutting any part of a segment heater element 42, 44, 46, 48, 50 in the heater mat segments 32, 34, 36, 38, 40 that are to remain as part of the functional heater appliance as long as the heater mat segments that remain are still connected to a part of the power bus 52 that is still electrically connected to the power cord 58. Therefore, of course, the heater mat segment 36, which has the part of the power bus 52 that connects to the power cord 58 in the example heater appliance 10, has to remain as part of the remaining heater appliance 10 after any other heater mat segment 32, 34, 38, 40 is removed in order for the remaining segment heater elements to operate and generate heat, as will be understood by persons skilled in the art once they understand the principles of this invention. In that sense, the heater mat segment 36 in the example trimmable heater appliance 10 can be considered as a master heater mat segment or main heater mat segment, and the other heater mat segments 32, 34, 38, 40 that are distal to the heater mat segment 36 can be considered as the trimmable heater mat segments. Consequently, a user would retain, as part of the remaining functional heater appliance 10, as many of the heater appliance segments that are most proximal to the location where the power bus 52 is connected to the power cord 58 as are desired to cover a desired length of the object to be heated.

As mentioned above and as shown, for example, in FIGS. 1, 2, 10, and 11, heater mat segment boundary indicia in the form of marks 12, 14, 16, 18 (or other indicia instrumentalities) are provided on the external surface of the thermal insulation layer 70 to indicate where the example trimmable heater appliance 10 can be cut or otherwise severed to separate or trim away on or more heater appliance segments 20, 22, 24, 26, 28 from other heater appliance segments 20, 22, 24, 26, 28 as desired. Those heater mat segment boundary indicia 12, 14, 16, 18 are aligned with the trimmable heater distances D on the heater mat 30, so that cutting or otherwise severing the trimmable heater appliance along any of those heater mat boundary indicia 12, 14, 16, 18 will not cut through or sever and part of the segment heater elements 42, 44, 46, 48, 50 that remain as parts of the remaining heater appliance 10. In the example trimmable heater appliance 10, which is illustrated as being in a cylindrical form, the heater mat segment boundary indicia 12, 14, 16, 18 are in radial alignment with the trimmable distances D of the heater mat 30. However, the trimmable heater appliance 10 does not have to be cylindrical. It can be made in other shapes, including, but not limited to flat trimmable heater appliances and can be flexible so that it can be wrapped around or otherwise conform to surfaces or shapes of objects to be heated.

Other heater mat segment boundary indicia can also be provided in addition to, or in lieu of, the indicator marks 12, 14, 16, 18. For example, as illustrated in FIGS. 10 and 11, heater mat segment boundary indicia in the form of marks 92, 94, 96, 98 (or other indicia instrumentalities as explained above) can be provided on a surface of the heater mat 30 in the trimmable distances D. Also, as illustrated for example in FIGS. 1, 2, 10, and 11, heater mat indicia in the form of marks 102, 104, 106, 108 (or other indicia instrumentalities as explained above) can be provided on a surface of the cover sheet 76 in alignment with the trimmable distances D of the heater mat 30. Any surface that is visible or that may be exposable to vision may be an appropriate place for such heater mat segment boundary indicia. For example, if the optional thermal insulation layer 70 is not included in a trimmable heater appliance, it may be desirable to provide at least a thin, electrically insulating protective sheet or heater superstrate (not shown in FIGS. 1-13) over the heater mat 30 to protect and electrically insulate the segment heater elements 40, 42, 44, 46, 48, in which case heater mat segment boundary indicia may be placed on an outer surface of such protective sheet. A heater superstrate over the segment heater elements can be provided regardless of whether the thermal insulation layer 70 is provided. See, for example, the outer isolation layer (superstrate) 350 in FIGS. 19-22.

Referring now primarily to FIGS. 8-11, the heater mat 30 can be fabricated initially on one or more dielectric or otherwise electrically non-conductive heater substrate sheets 110. For example, the heater substrate sheets 110 may comprise a thin film polyimide such as Kapton (trademark of E.I. du Pont de Nemours and Company) or a similar polyimide material with a thickness in a range of 0.3 mil to 5.0 mil, although other thicknesses may be appropriate for particular situations or applications. Other electrically non-conductive heater substrate materials may include a silicone material, a fiberglass, or some other material. The example heater mat segments 32, 34, 36, 38, 40 shown in FIG. 8 can be fabricated on individual heater substrate sheets 110, or multiple heater mat segments can be fabricated together on large or long heater substrate sheets 110 as illustrated, for example, by the roll 112 of multiple heater mat segments on a long heater substrate sheet 110. The segment heater elements 42, 44, 46, 48, 50 can be fabricated onto the heater substrate material 110 in any convenient manner, for example, by laying and adhering a conductive wire onto the heater substrate material 110, ink jet printing a conductive ink material onto the heater substrate material 110, vapor deposition or other deposition techniques of producing a conductive material on the heater substrate material 110.

As mentioned above, the trimmable heater appliances can be made with as many heater mat segments as desired and for any desired length, so any number of heater mat segments can be cut from the roll 112 and either fabricated together, e.g., not separated, into a heater mat 30 of any desired length. As shown in FIG. 9, the fabrication process can include silk screening or otherwise providing the heater mat segment boundary indicia 92, 94, 96, 98 in the trimmable distances D, which can be used as a guide for cutting any number of heater mat segments from the roll 112 or left intact for use as the heater mat segment boundary indicia 92, 94, 96, 98 shown in FIGS. 10 and 11. The desired number of heater mat segments, e.g., heater mat segments 32, 34, 36, 38, 40, can be formed into a heater mat 30 of any desired shape, for example, the cylindrical shape illustrated in FIGS. 10 and 11, by any convenient technique. For example, as shown in FIG. 10, the heater mat segments 32, 34, 36, 38, 40 are rolled onto a mandrel M (shown in phantom lines). Depending on the heater substrate material used, the heater mat segments 32, 34, 36, 38, 40 can then be vulcanized on the mandrel M into the cylindrical shape and size of the mandrel M or they may be formed and retained in that shape and size by attaching the thermal insulation layer 70. Of course, the heater mat segments can also be flat similar to the alternate example illustrations in FIGS. 18-23, and they can be flexible so that they can be rolled or wrapped around an object to be heated. They can also be fabricated to have a specific rigid shape as desired. Persons skilled in the art will also understand that a variety of other fabrication and assembly methods and techniques can be used to fabricate trimmable heater mats and appliances once they understand the principles of this invention. For example, but not for limitation, the segment heater elements could be fabricated on a separate sheet and then stitched, bonded, or otherwise fastened to a base material or substrate which can be, but does not have to be, a dielectric or other electrical insulation material.

Figure 5:
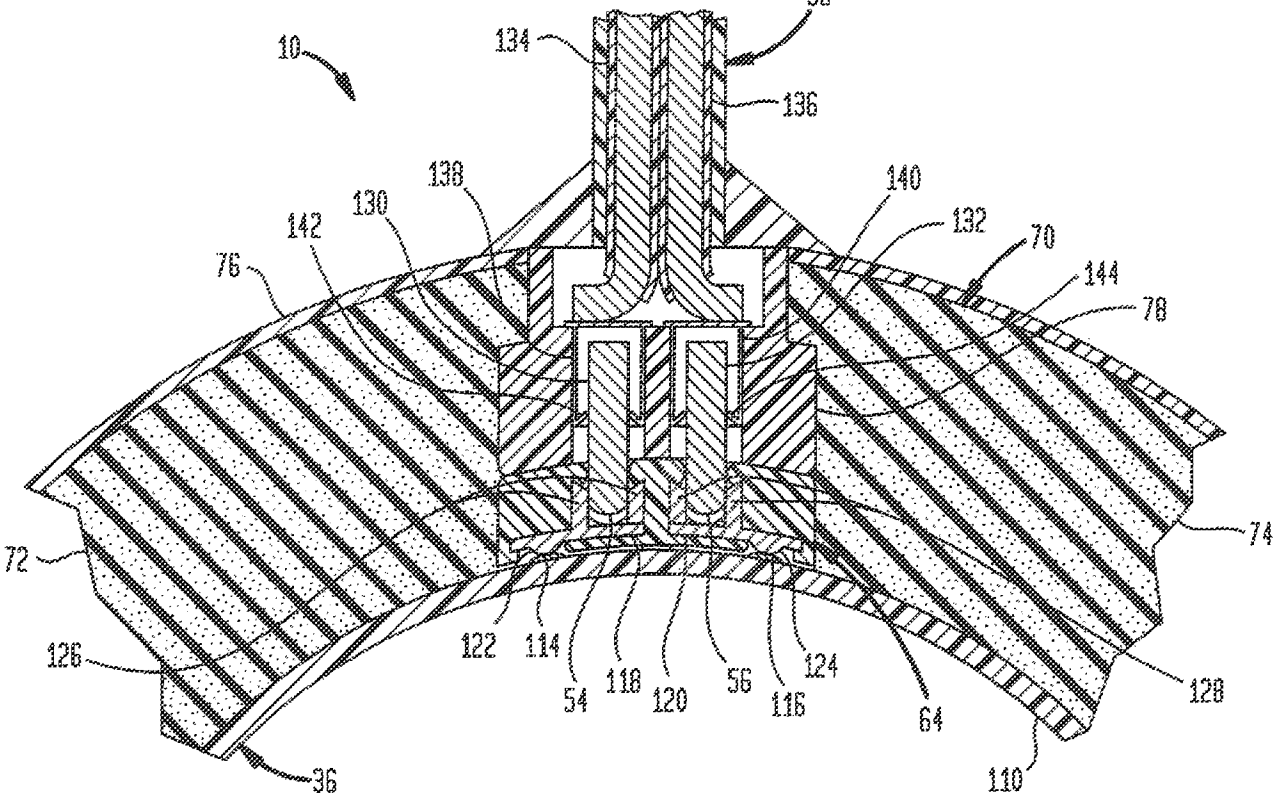
FIG. 5 is an enlarged portion of the cross-section view in FIG. 4, which is encircled by the broken line circle in FIG. 4, illustrating an example connection of a power supply cord to power conductors of a bus in the example heater appliance and to a heater element in the example heater appliance.
Figure 6:
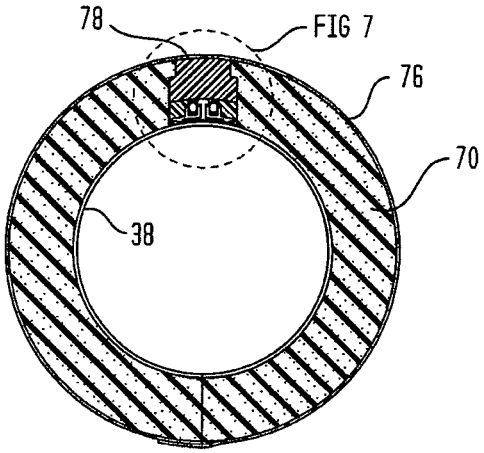
FIG. 6 is a cross-section view of the example heater appliance taken along section plane 6-6 in FIG. 2.
Figure 7:
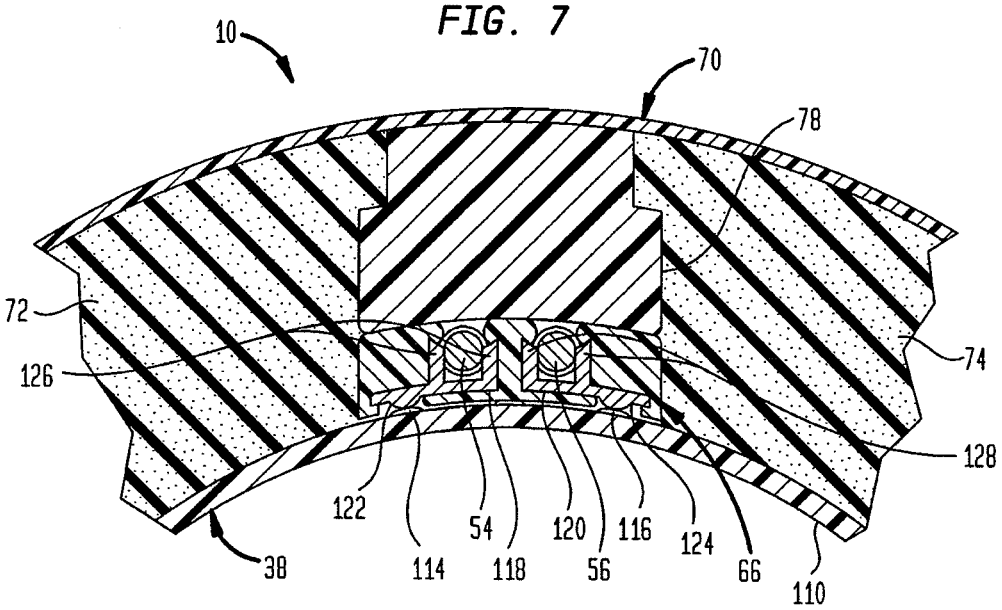
FIG. 7 is an enlarged portion of the cross-section view in FIG. 6, which is encircled by the broken line circle in FIG. 6, illustrating an example connection of the power conductors of a bus to the heater element in the example heater appliance.
Figure 8:
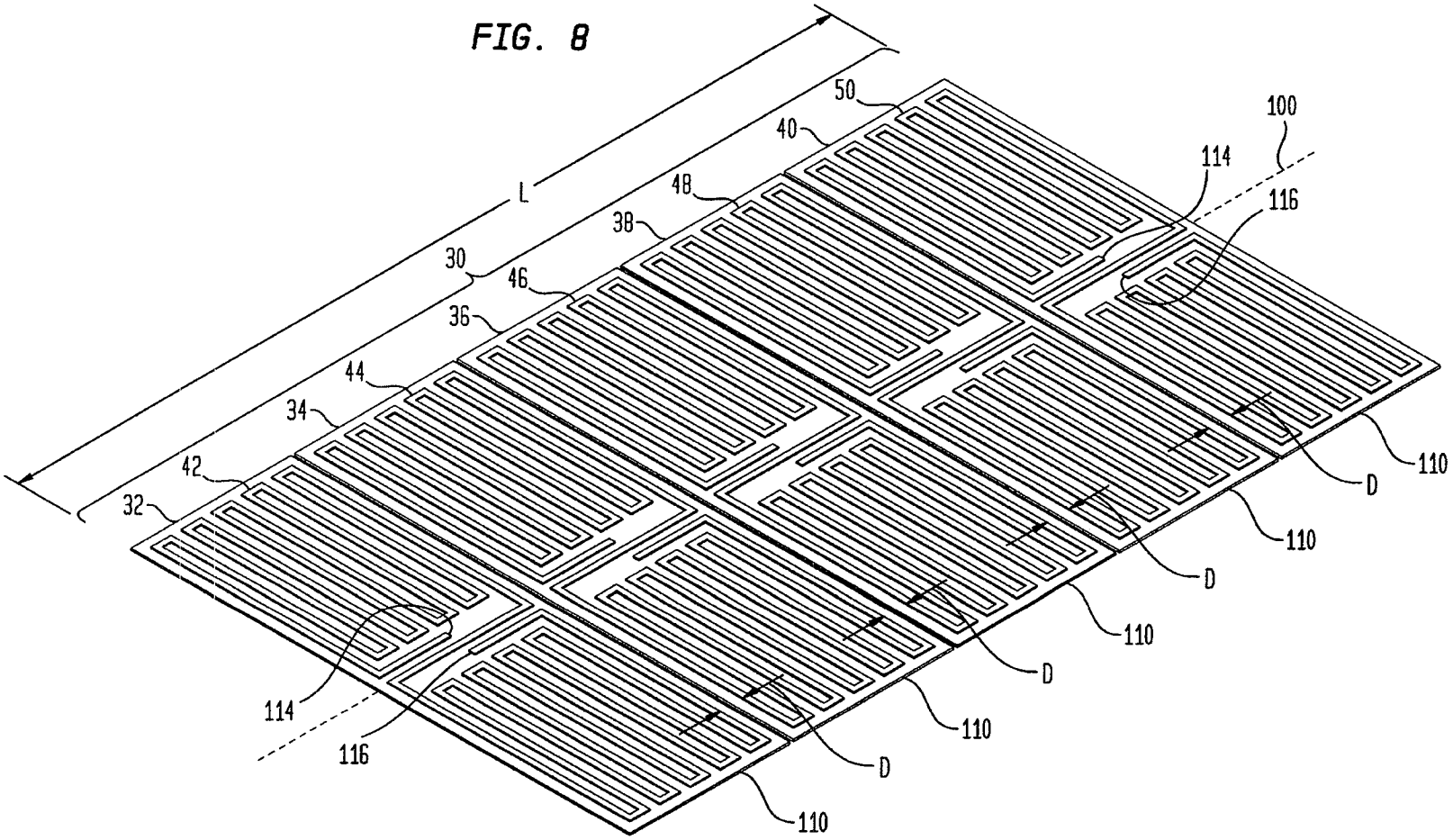
FIG. 8 is an isometric view of a plurality of example heater mat segments that may be used to form a heater mat in the a trimmable heater appliance of the type illustrated in FIG. 1.

As also best seen in FIGS. 8-11, each of the example segment heater elements 42, 44, 46, 48, 50 is illustrated as a strand or trace of electrically resistive material laid in a pattern on the heater substrate 110 as a long, circuitous loop with two ends, e.g., a first end 114 and a second end 116. Those two loop ends 114, 116 of each segment heater element 42, 44, 46, 48, 50 are connected electrically to the power bus 52 by the self-stripping tap connectors 60, 62, 64, 66, 68, respectively. For example, as best seen in FIGS. 5 and 7 with secondary reference to FIGS. 10 and 11, each self-stripping tap connector 60, 62, 64, 66, 68 (represented by the self-stripping tap connectors 64, 66 in FIGS. 5 and 7, respectively), has a first connector bracket 118 and a second connector bracket 120 for connecting the first loop end 114 and the second loop end 116, respectively, to the first power conductor 54 and the second power conductor 56 of the power bus 52. The first connector bracket 118 has a first bottom contact 122 exposed under its bottom surface, and the second connector bracket 120 has a second bottom contact 124 exposed under its bottom surface. The first bottom contact 122 and the second bottom contact 124 are spaced the same distance apart as the first and second loop ends 114, 116 of the segment heater element. Therefore, when the self-stripping tap connectors 64, 66 are pressed into place as shown in FIGS. 5 and 7, the first bottom contact 122 is placed into contact with the first loop end 114, and the second bottom contact 124 is placed into contact with the second loop end 116, respectively.

Also, the first connector bracket 118 has a first pair of juxtaposed, upwardly extending knife contacts 126, and the second connector bracket has a second pair of juxtaposed, upwardly extending knife contacts 128. When the first and second power conductors 54, 56 of the power bus 52 are pressed into the self-stripping tap connectors 64, 66, the first pair of knife contacts 126 slice through the electrical insulation on the first power conductor 54 to make electrical contact with the first power conductor 54, and the second pair of knife contacts 128 slice through the electrical insulation on the second power conductor 56 to make electrical contact with the second power conductor. The first and second connector brackets 118, 120 are electrically conductive. Therefore, with the first bottom contact 122 in contact with the first loop end 114 and the first pair of knife contacts 126 in contact with the first power conductor 54, the first connector bracket 118 effectively connects the first loop end 114 electrically to the first power conductor 54. Likewise, with the second bottom contact 124 in contact with the second loop end 116 and the second pair of knife contacts 128 in contact with the second power conductor 56, the second connector bracket 118 effectively connects the second loop end 116 electrically to the second power conductor 56. As best seen in FIG. 7, when the cover sheet 76 is fastened in place, the rib 78 isolates the first and second power conductors 54, 56 and the first and second connector brackets 118, 120 from the exterior of the example trimmable heater appliance 10 and holds the self-stripping tap connectors 60, 62, 64, 66, 68 in place to secure the electrical connections of the segment heater elements 42, 44, 46, 48, 50 to the power bus 52.

As best seen in FIGS. 5, 10, and 11, the power bus 52 includes two prongs 130, 132 to facilitate electrical connection of the power bus 52 to the power cord 58. The first prong 130 is connected to the first power conductor 54 of the power bus 52, and the second prong 132 is connected to the second power conductor 56. As best seen in FIG. 5, first and second cord wires 134, 136 in the power cord 58 are connected respectively to electrically conductive first and second prong sockets 138, 140 in the rib 78. When the cover sheet 76 along with the rib 78 and power cord 58 are fastened in place, the first and second prongs 130, 132 protrude into the first and second prong sockets 138, 140, respectively, which make electrical contact with the prongs 130, 132, for example, at lips 142, 144 in the prong sockets 138, 140. Therefore, the first and second prongs 130, 132 and the first and second prong sockets 138, 140, when assembled together as described, effectively make the electrical connections of the first and second cord wires 134, 136 in the power cord 58 to the first and second power conductors 54, 56 of the power bus 52. Of course, this example connection of the first and second cord wires 134, 136 in the power cord 58 to the first and second power conductors 54, 56 of the power bus 52 is not the only way to make those connections, and persons skilled in the art may devise other connections once they understand the principles of this invention. Also, heat sensors (not shown), thermal switches or fuses (not shown), and other heater control and data features can also be added to or used with the trimmable heater appliance 10 as described, for example, in U.S. Pat. No. 6,894,254 (Hauschultz), U.S. Pat. No. 7,932,480 (Gu, et al.), and U.S. Pat. No. 8,541,716 (Gu, et al.).

Figure 12:
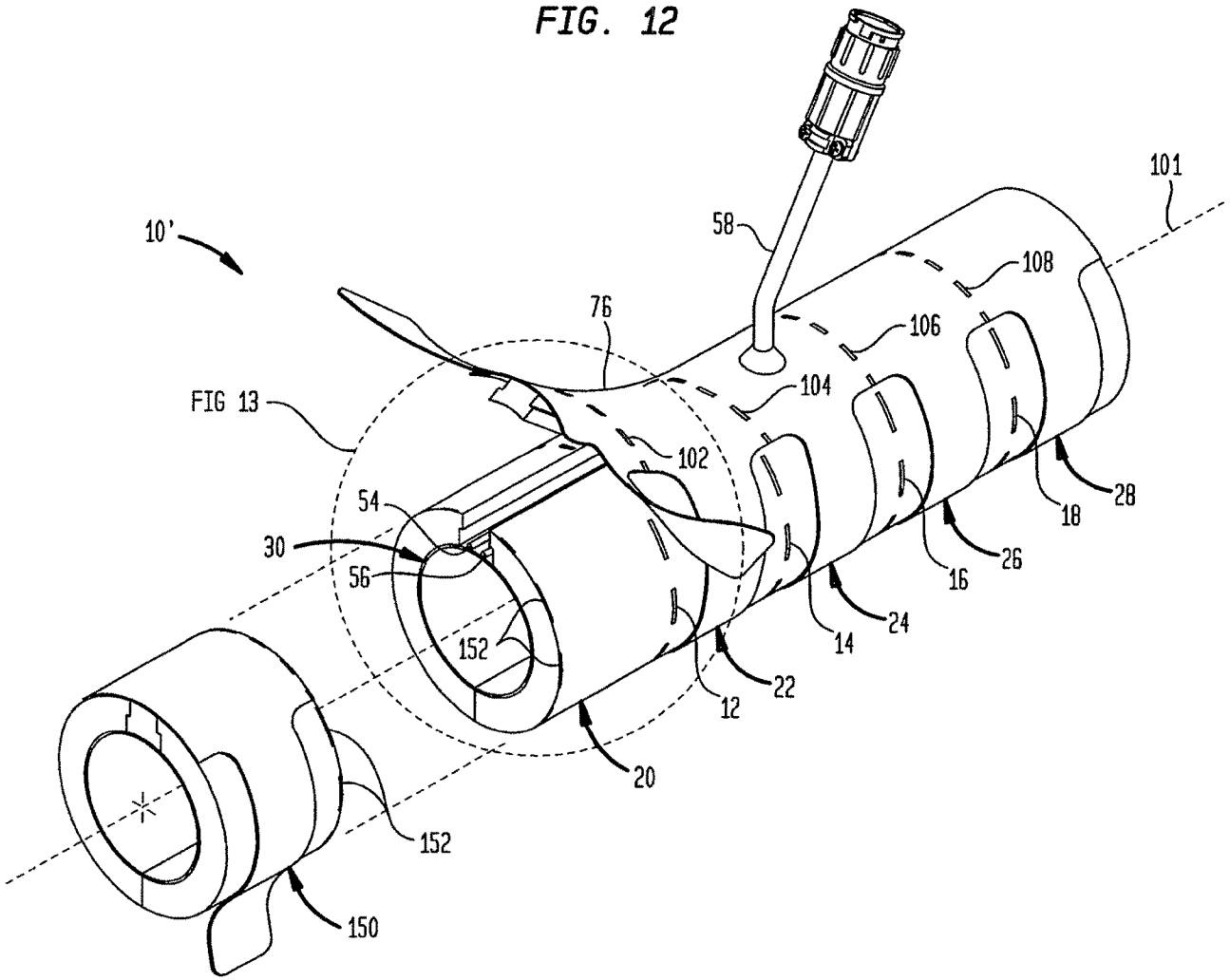
FIG. 12 is an isometric view of the example trimmable heater appliance in FIG. 1, but illustrating the cover sheet partially peeled back to reveal the power bus and heater mat segment boundary indicia, and also illustrating in phantom lines a distal segment of the example heater appliance severed from the remaining example heater appliance along a set of heater mat segment boundary indicia as may be done to trim the length of the example trimmable heater appliance in FIG. 1.

The example trimmable heater appliance 10' in FIG. 12 is similar to the example trimmable heater appliance 10 in FIGS. 1-11 and described above, except that it shows a sixth heater appliance segment 150, which has been severed from the heater appliance segment 20 and removed from the remainder of the heater appliance 10' to further illustrate the trimming features and processes. To sever and remove the more distal heater appliance segment 150 from the more proximal heater appliance segment 20 (in relation to location where the power cord 58 is connected to the power bus 52 as explained above), the example heater appliance 10' is cut or otherwise severed at a location marked by heater mat segment boundary indicia 152, which is aligned with a trimmable distance D (not shown in FIG. 12) in the heater mat 30 as explained above. Also, the cover sheet 76 is shown in FIG. 12 peeled back along with the rib 78 to facilitate exposing and trimming the power conductors 54, 56 of the power bus 52, which can be done either before or after the heater appliance segment 150 is severed and removed.

Figure 13:
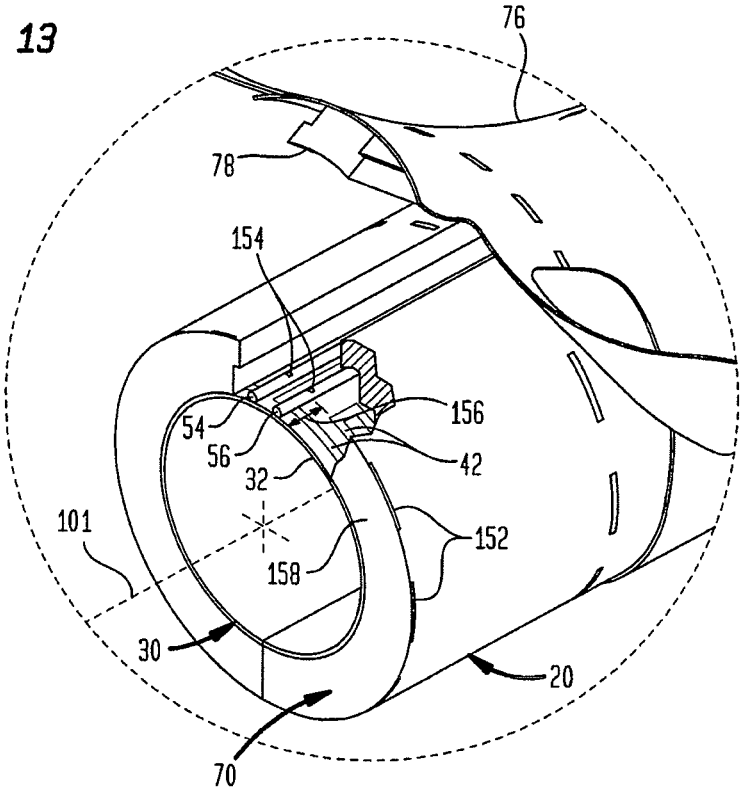
FIG. 13 is an enlarged portion of the isometric view in FIG. 13 that is encircled by the broken line circle in FIG. 13 to illustrate the bus trim location indicia on the power bus.

To explain further, reference is now made primarily to the enlarged FIG. 13 view of the remaining heater appliance segment 20, which is shown with a portion of the thermal insulation layer 70 cut away to reveal more of the power conductors 54, 56 and a part of the segment heater element 42 of the heater mat segment 32. Bus trim location indicia 154 are provided on the power conductors 54, 56 to indicate an appropriate location for cutting, trimming, or otherwise severing the power conductors 54, 56. The bus trim location indicia 154 are severable bus locations on the power conductors 54, 56 between segment connection locations at a longitudinal offset or setback distance 156 into the heater appliance segment 20 from the cut face or edge 158 of the heater mat segment 32, which was cut or otherwise severed in a cut plane marked by the heater mat segment boundary indicia 152. The segment connection locations in the example trimmable heater appliance 10 are at the locations of the self-stripping tap connectors 60, 62, 64, 66, 68 described above. A purpose of the setback distance 156 for cutting or otherwise severing the power conductors 54, 56 is so that the bare, cut ends of the power conductors 54, 56, after cutting the power conductors 54, 56 on the bus trim location indicia 154, will be setback from the exposed cut face or edge 158 by the setback distance 156, where they will be covered and electrically isolated from each other and from persons or extraneous objects by replacement of the cover sheet 76 and rib 78 onto the thermal insulation layer 70 and into the gap 80 as discussed above. Such setback and covering of the cut ends of the power conductors 54, 56 by the cover sheet 76 and rib 78 prevents accidental shock to a person who may touch the exposed cut face or edge 158 and prevents short circuits or other damage to the heater that could result from extraneous objects coming into contact with the cut ends of the power conductors 54, 56. Also, the bus trim location indicia 154 can be offset a distance 156 that avoids possible contact of the bare faces of the power conductors 54, 56 with the heater mat segment 42.

Figure 14:
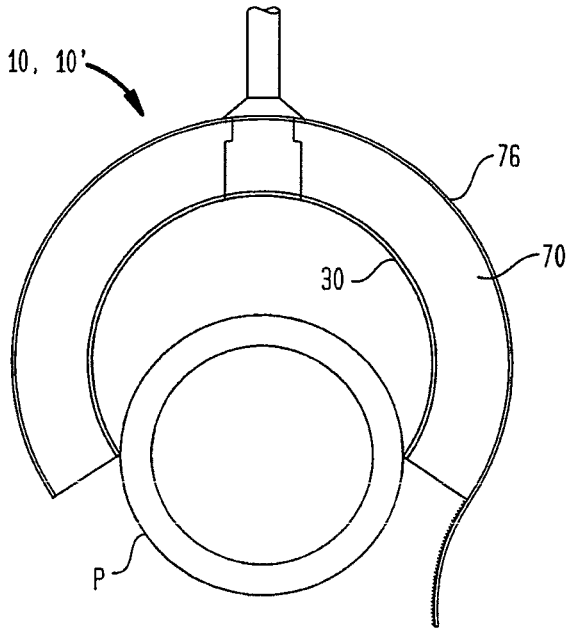
FIG. 14 is an end elevation view similar to FIG. 3, but illustrating an example of how the example trimmable heater appliance in FIG. 1 is deformable for insertion over and mounting on an object to be heated.

The seam 160 where the opposite edges of the thermal insulation layer 70 meet and the opposite edges of the heater mat 30 meet are left not joined so that the heater appliance 10, 10', can be spread or opened as shown in FIG. 14 for insertion over an object, e.g., pipe P, to be heated.

Figure 15:
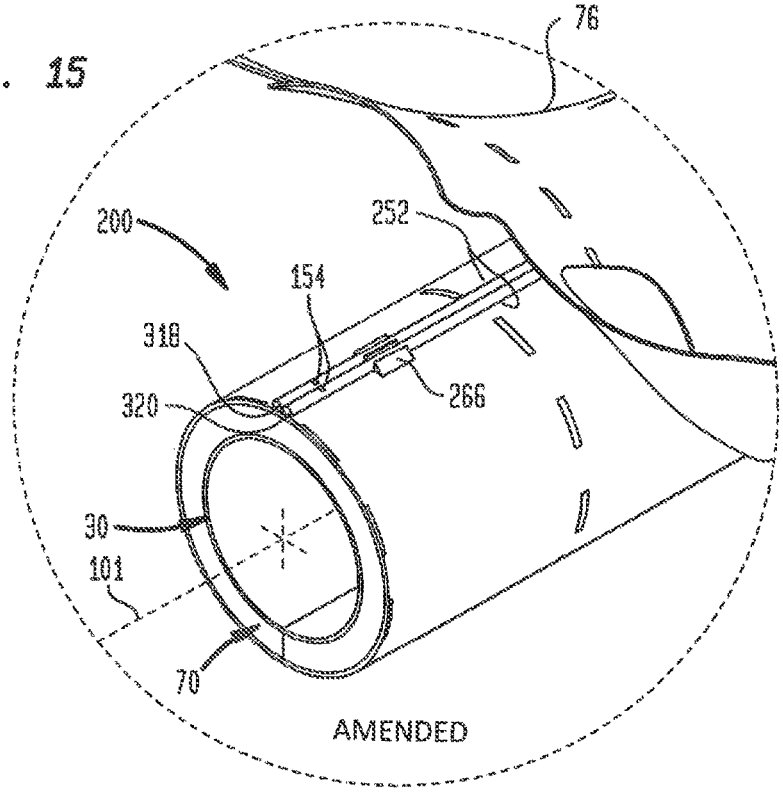
FIG. 15 is an enlarged isometric view with the cover sheet peeled back similar to FIG. 13, but illustrating an alternate example trimmable heater appliance embodiment in which the power bus is mounted over the thermal insulation layer and directly under the cover sheet.
Figure 16:
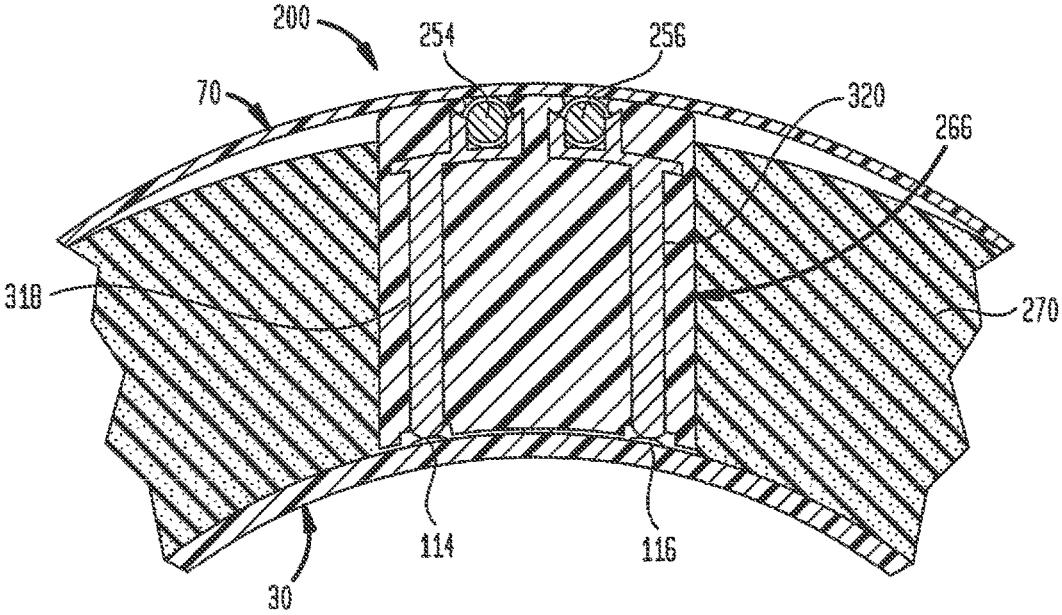
FIG. 16 is an enlarged portion of a cross-section of similar to FIG. 7, but illustrating an example connection of the power bus of the alternate example trimmable heater appliance embodiment in FIG. 15 to the heater element.
Figure 17:
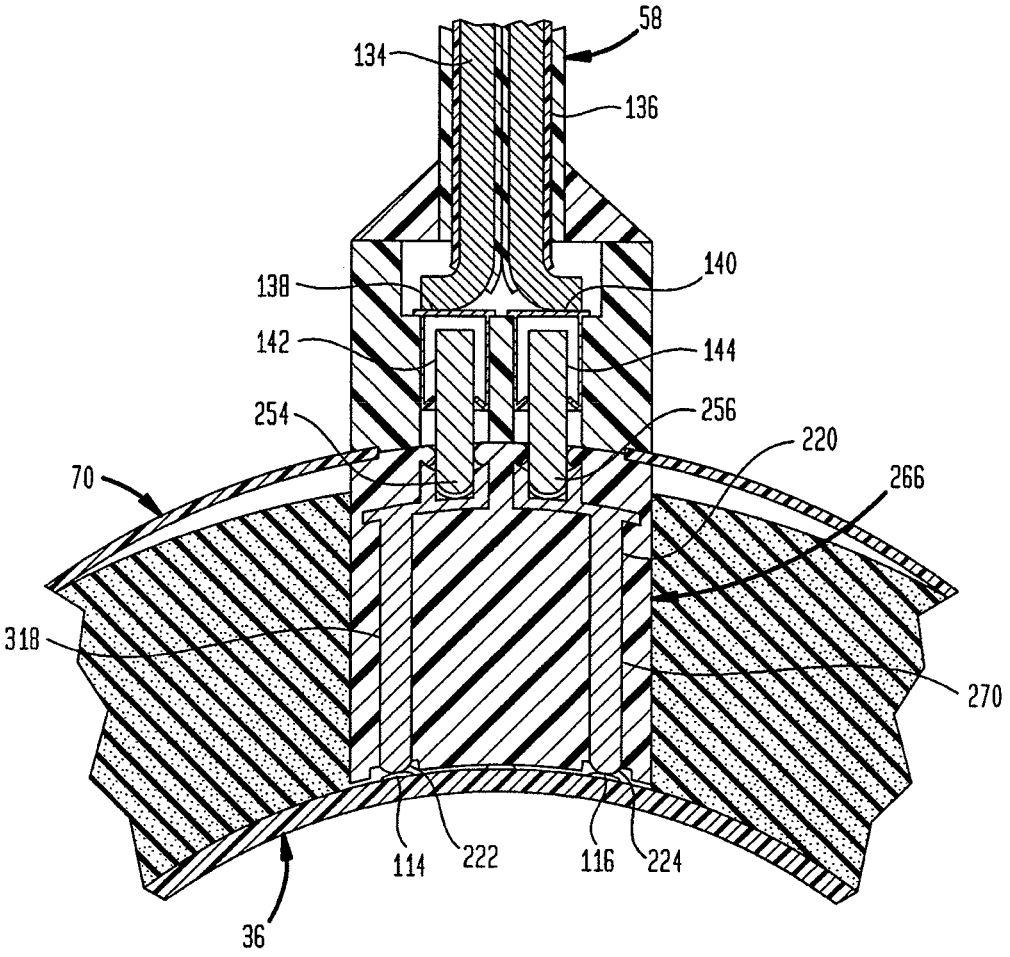
FIG. 17 is an enlarged portion of a cross-section similar to FIG. 5, but illustrating an example connection of a power supply cord to the power conductors of the power bus and to the heater element in the alternate example trimmable heater appliance in FIG. 15.

An example alternate embodiment trimmable heater appliance 200 is shown in FIGS. 15-17, wherein the power bus 252 is mounted over the thermal insulation layer 270 instead of on the heater mat 30. Therefore, a longer self-stripping tap connector 266 with longer first and second bracket connectors 218, 220 can be provided with longer bottom contacts 222, 224 to span that additional thickness of the thermal insulation to connect the loop ends 114, 116 to the power conductors 254, 256. Otherwise, the example longer self-stripping tap connector 266 in FIGS. 16 and 17 are quite the same as the self-stripping tap connectors 60, 62, 64, 66, 68 as shown in FIGS. 5, 7, 10, and 11 and described above, although the rib 78 is not needed.

Figure 18:
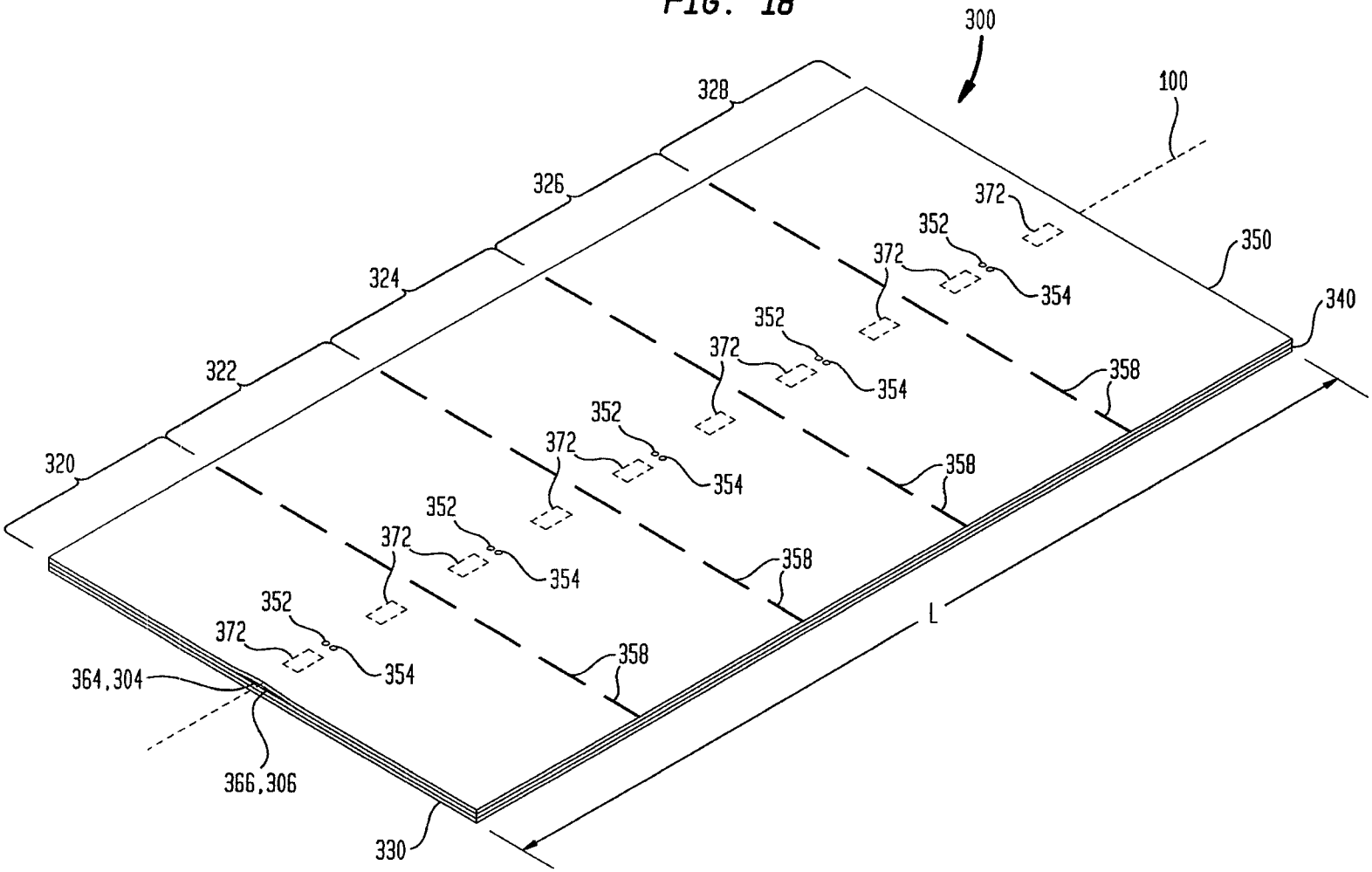
FIG. 18 is an isometric view of an example alternate heater mat illustrating the power bus formed as an integral part of the heater mat.
Figure 19:
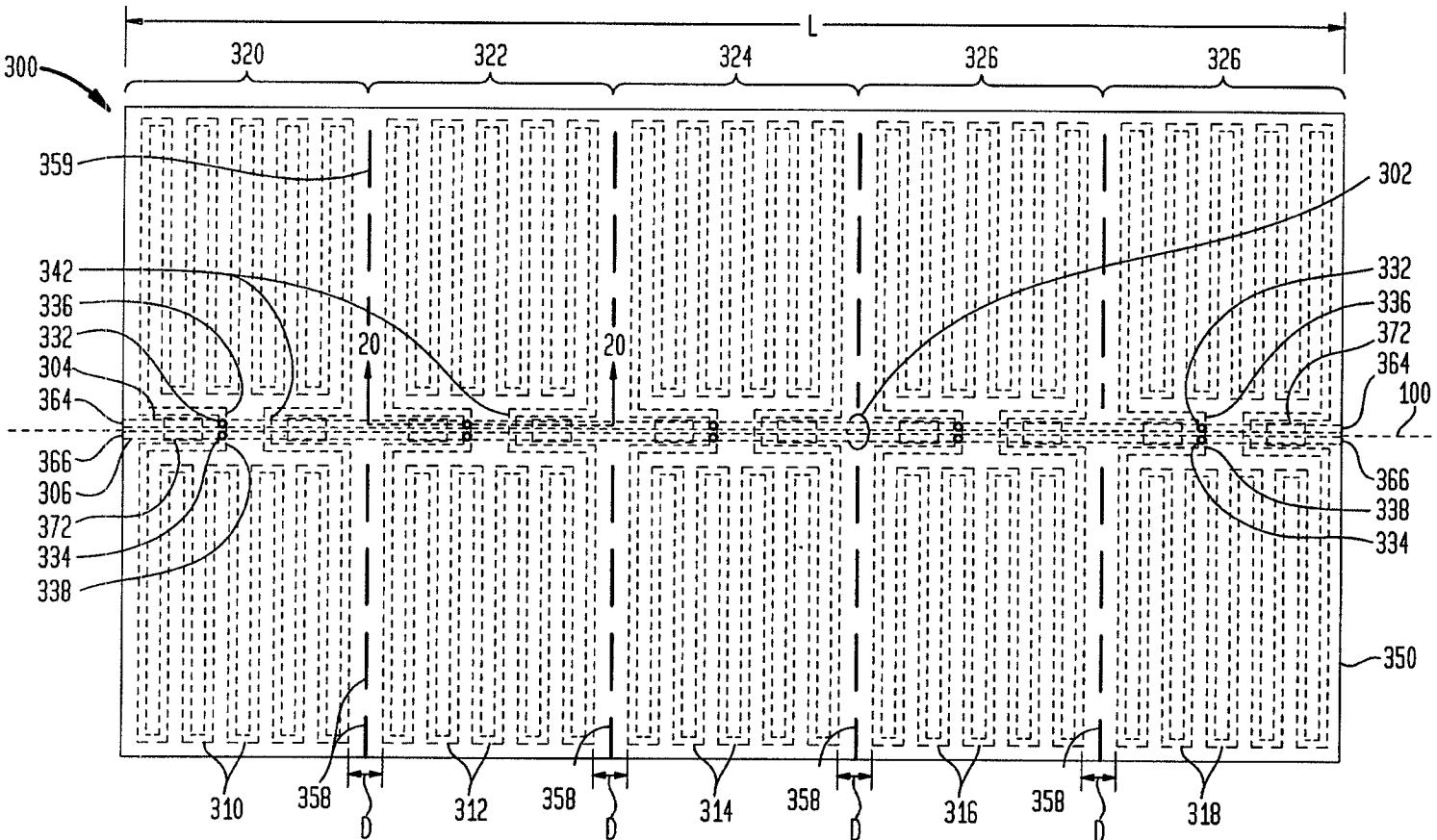
FIG. 19 is a top plan view of the example alternate heater mat in FIG. 18 showing the segment heater elements and the power bus in phantom lines.
Figure 20:
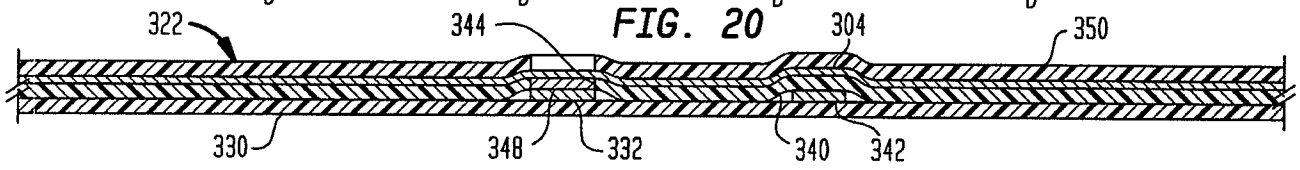
FIG. 20 is an enlarged cross-section view of one of the heater mat segments of the example alternate heater mat in FIG. 19.
Figure 21:
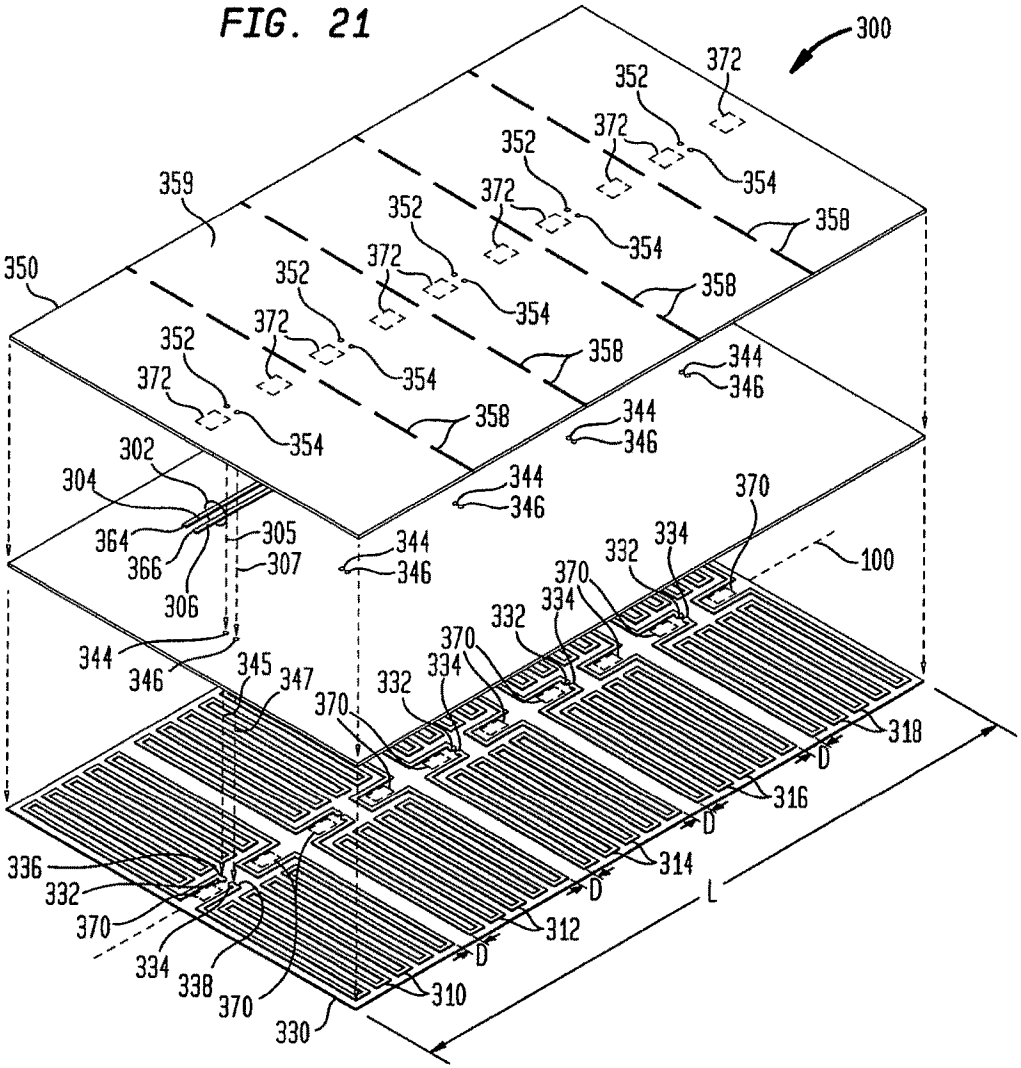
FIG. 21 is an exploded isometric view of the example alternate heater mat in FIGS. 18 and 19.

An alternate example heater mat 300 shown in FIGS. 18-22 has a power bus 302 comprising a first power conductor 304 and a second power conductor 306 formed as an integral part of the heater mat 300. As best seen in FIGS. 19, 20, and 21, the segment heater elements 310, 312, 314, 316, 318 of the respective heater mat segments 320, 322, 324, 326, 328 are positioned on a heater substrate sheet 330 as described above for the segment heater elements 42, 44, 46, 48, 50 of the example trimmable heater appliance 10 in FIGS. 1-11. Also, the same kinds of materials can be used for segment heater elements 310, 312, 314, 316, 318 and the heater substrate sheet 330 as described above for the example trimmable heater appliance 10 in FIGS. 1-11, and those segment heater elements 310, 312, 314, 316, 318 and heater substrate sheet 330 provide essentially the same functions as the segment heater elements 42, 44, 46, 48, 50 and heater substrate sheet 110 of the example trimmable heater appliance 10 in FIGS. 1-11.

The first and second power conductors 304, 306 of the power bus 302 are formed and provided as an integral part of the alternate heater mat 300. In the example alternate heater mat 300 shown in FIGS. 18-22, the first and second power conductors are positioned to span longitudinally across the central portions of the plurality of the segment heater elements 310, 312, 314, 316, 318 of the heater mat segments 320, 322, 326, 328, e.g., along opposite sides of the longitudinal axis 100. Each of the plurality of segment heater elements 310, 312, 314, 316, 318 has two power bus connection pads 332, 334, one at each respective end 336, 338 of the respective segment heater element, to provide electrical connections between the power bus 302 and each of the segment heater elements 310, 312, 314, 316, 318 at segment connection locations in the power bus 302 that align with the power bus connection pads 332, 334. As will be explained in more detail below, one of the power bus connection pads, e.g., the first power bus connection pad 332, is connected electrically to the first power conductor 304, and the other one of the power bus connection pads, e.g., the second power bus connection pad 334, is connected electrically to the second power conductor 306. Therefore, in this example alternate trimmable heater mat 300, the segment heater elements 310, 312, 314, 316, 318 are connected in electrical parallel to the power bus 302.

The power bus 302 in the example heater mat 300 in FIGS. 19-22 is positioned on a dielectric interstitial isolation layer 340 in juxtaposed relation with the segment heater elements 310, 312, 314, 316, 318. The dielectric interstitial layer 340 is positioned as a superstrate over the segment heater elements 310, 312, 314, 316, 318 on the heater substrate sheet 330 so that the segment heater elements segment heater elements 310, 312, 314, 316, 318 are sandwiched between the heater substrate sheet 330 and the dielectric interstitial layer 340. The dielectric interstitial isolation layer 340 can be, for example, a thin film polyimide such as Kapton (trademark of E.I. du Pont de Nemours and Company) or a similar polyimide material, fiberglass, or some other electrically non-conductive material in a thickness range of 0.03 mil to 5.0 mil, although other thicknesses may be appropriate for particular situations or applications. The first and second power conductors 304, 306 can be any known electrically conductive material that can withstand the temperatures produced by the segment heater elements 310, 312, 314, 316, 318 as would be well-known to persons skilled in the art, and they can be placed on the interstitial isolation layer 340 in any known manner, e.g., by laying and adhering a conductive wire onto the interstitial isolation layer 340 or by ink jet printing a conductive ink material onto the heater substrate material 110, vapor deposition, or other deposition techniques of producing a conductive material on the interstitial isolation layer 340. The dielectric interstitial isolation layer 340 is positioned over the segment heater elements 310, 312, 314, 316, 318 to electrically isolate the first and second power conductors 304, 306 of the power bus 302 from the segment heater elements 310, 312, 314, 316, 318 to prevent an electrical short circuit, especially where the first and second power conductors 304 cross a part of the segment heater elements, e.g., at the part 342 of the example segment heater elements 310, 312, 314, 316, 318 as best seen in FIGS. 19 and 20.

The interstitial isolation layer 340 has two power connection pass-through holes, e.g., a first power connection pass-through hole 344 and a second power connection pass-through hole 346, for each heater mat segment 320, 322, 324, 326, 328. The pass-through holes 344, 346 are sized and positioned for alignment with the respective first and second power bus connection pads 332, 334 of the respective segment heater elements 310, 312, 314, 316, 318 as indicated by the arrows 345, 347 in FIG. 21. The first and second power conductors 304, 306 of the power bus 302 are positioned over the respective first and second power connection pass-through holes 344, 346 in each heater mat segment 320, 322, 324, 326, 328, as illustrated by the arrows 305, 307 in FIG. 21, to make an electrical contact with the respective first and second power bus connection pads 332, 334 of each segment heater element 310, 312, 314, 316, 318. The electrical connection of the first power conductor 304 to the first power bus connection pad 332 through the first power connection pass-through hole 344 is illustrated in the FIG. 20 enlarged cross-section view of the of the segment heater element 312, but the other electrical connections of the first and second power conductors 304, 306 to the respective first and second power bus connection pads 332, 334 are similar. The electrical connection can be made as part of the process of forming the power bus 302. For example, if the segment heater elements 310, 312, 314, 316, 318 and the first and second power conductors 304, 306 of the power bus 302 are formed in situ by an operation such as ink jet printing, vapor deposition, or some flowable method, the conductive interface between the segment heater elements and the first and second power conductors can be formed at the same time in the same manner. As shown in FIG. 20, an optional conductive interface material 348, such as solder, can be provided between the power conductors 304, 306 and the power bus connection pads 332, 334 to facilitate effective electrical connection between those components, for example, by spot welding during the fabrication process.

An optional outer isolation layer (sometimes also referred to as a superstrate) 350 comprising a dielectric or other electrically insulating material is shown in the example heater mat 300 in FIGS. 18-22 positioned over the power conductors 304, 306 of the power bus 302 on the interstitial isolation layer to protect the power bus conductors 304, 306 and to prevent people or extraneous objects from coming into electrical contact with the power bus conductors 304, 306. Optional first and second power cord connection through-holes 352, 354 can be provided in the outer isolation layer 350 in alignment with the first and second power conductors 304, 306, respectively, to accommodate connection of a power cord 356 (see FIG. 22) to the first and second power conductors 304, 306 of the power bus 302. In the FIGS. 18-22 example, the first and second power cord connection through-holes 352, 354 are provided in all of the heater map segments 320, 322, 324, 326, 328 so that a power cord 356 can be connected to any selected one or more of the heater map segments. For example, if the heater map segments 320, 322, 324, 326, 328 are fabricated along with many more identical heater mats in long strips, e.g., similar to the long strip of heater mat segments 92, 94, 96, 98, et. seq., in the roll 112 in FIG. 9, any number of such heater mat segments can be cut from the long strip to make a heater appliance of a desired longitudinal length L, and a power cord 356 can then be electrically connected to the power conductors 304, 306 of the power bus 302 at any of such heater mat segments to provide power via the power bus 302 to all of the segment heater elements in the heater appliance. However, such power cord connection through-holes 352, 354 could be provided on only some of the heater mat segments if desired.

The example heater mat 300 is shown as a component in an example trimmable heater appliance 360 with an optional thermal insulation layer 362 covering the heater mat 300. The thermal insulation layer 362 covers the power cord connection through-holes 352, 354 so that the power conductors 304, 306 of the power bus 302 are not exposed through the through-holes 352, 354. However, if the heater mat 300 is used in a trimmable heater appliance that does not have such a thermal insulation layer 362, the power cord connection through-holes 352, 354 that are not used for connecting the power cord 356 to the power bus 302 can be covered with some other protective material, for example, a dielectric tape, to protect the power bus 302 and to prevent persons or extraneous objects from contacting the power conductors 304, 306 of the power bus 302.

As best seen in FIGS. 19 and 21, there is a trimmable distance D between the juxtaposed segment heater elements 310, 312, 314, 316, 318 of the respective heater mat segments 320, 322, 324, 326, 328. As explained above regarding the FIGS. 1-17 example trimmable heater appliance 10, any of the juxtaposed heater mat segments 320, 322, 324, 326, 328 can be cut apart from each other in the trimmable distance D without cutting or interfering with the segment heater elements of each other and without interfering with the electrical connections of the segment heater elements in the remaining heater mat segments to the first and second power conductors 304, 306 of the power bus 302. Heater mat segment boundary indicia 358 are provided on an exposed or accessible surface 359 of the heater mat 300 in alignment with the trimmable distances D to provide a visual indication of where the heater mat 300 can be cut to trim or cut away one or more of the heater mat segments 320, 322, 324, 326, 328 from one or more remaining heater mat segments without cutting or interfering with the segment heater elements of the remaining heater mat segments and without interfering with the electrical connections of the segment heater elements of the remaining heater mat segments with the first and second power conductors 304, 306 of the power bus 302. If the optional thermal insulation layer 362 (FIG. 22) is provided, such heater mat segment boundary indicia 358 and also be provided on an exposed or accessible surface 361 of the thermal insulation layer 362.

Figure 22:
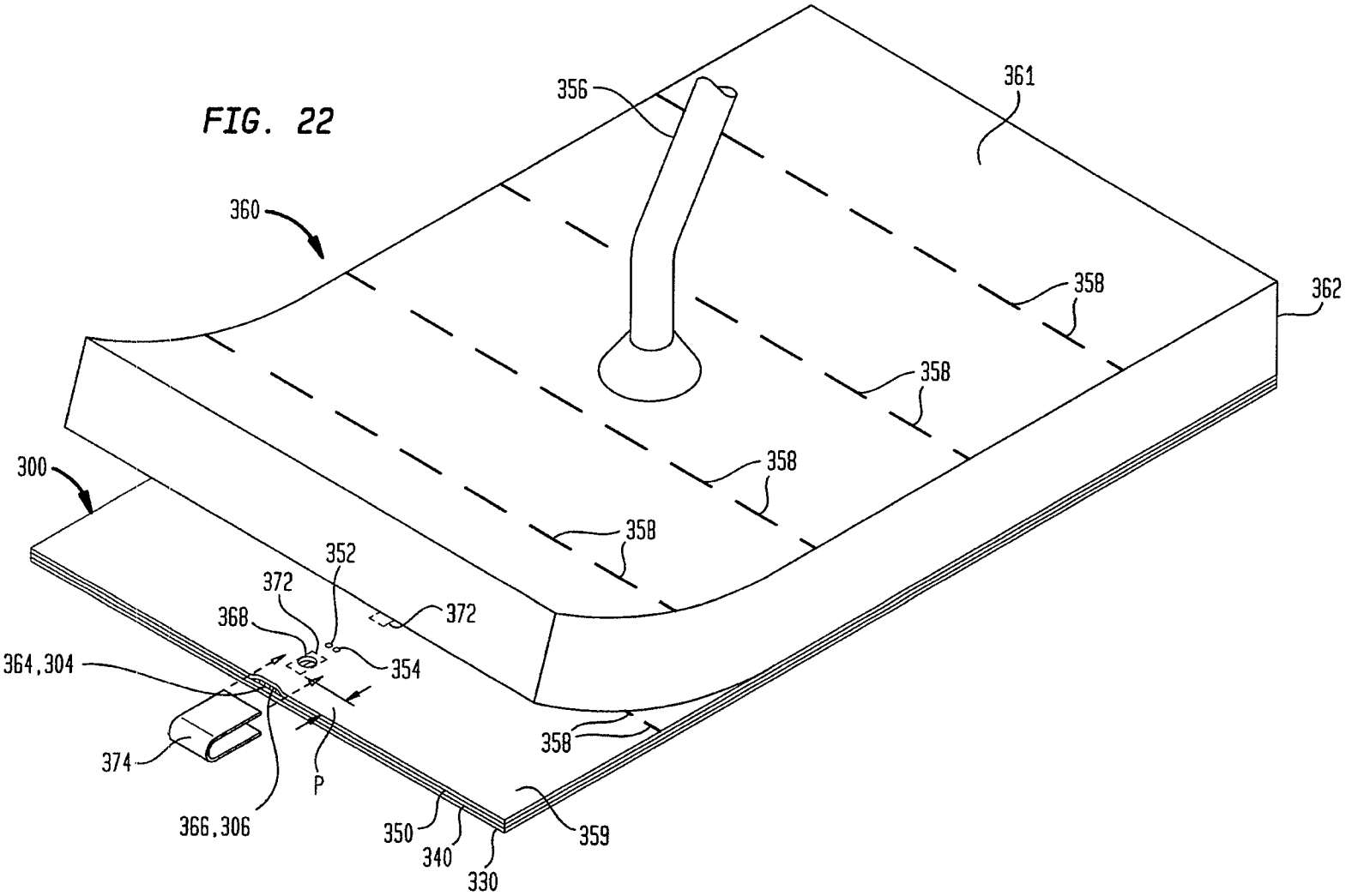
FIG. 22 is an isometric view of the example alternate heater mat in FIGS. 18 and 19 with a thermal insulation layer mounted on the heater mat shown partially lifted to illustrate example isolations for exposed power bus ends.

When heater mat 300 is cut from a long strip comprising many heater mat segments, or when one heater mat segment is cut away from the remaining heater mat segments as explained above, the cut distal ends 364, 366 of the respective first and second power conductors 304, 306 may be exposed as shown, for example, in FIGS. 18, 19, and 22. Such exposed distal ends 364, 366 of the power conductors 304, 306 can be a shock hazard to a person who might touch them or a safety hazard due to possible sparks or short circuits. Such shock or safety hazards can be mitigated in a number of ways. For one example, an isolation hole 368 can be punched through the heater mat 300, as shown in FIG. 22, a distance P spaced inwardly from the distal ends 364, 366 to sever the power conductors 304, 306 that distance P from the distal ends 364, 366. With the power conductors 304, 306 severed in that manner, the distal ends 364, 366 are benign and no longer a shock or safety hazard. As best seen in FIGS. 19 and 21, the segment heater elements 310, 320, 322, 324, 326, 328 are positioned in a manner on the heater substrate sheet 330 that leaves at least one punch zone 370 in each heater segment 320, 322, 324, 326, 328 over or through which the power conductors 304, 306 pass, but in which no part of the segment heater elements 310, 320, 322, 324, 326, 328 extends. Therefore, the isolation hole 368 punched through the punch zone 370 can sever the power conductors 304, 306 without severing or interfering with any part of the segment heater elements 310, 320, 322, 324, 326, 328. Punch zone indicia 372 are provided on an exposed or accessible surface 359 of the heater mat 300 in alignment with the punch zones 370 to indicate where the isolation holes 368 can be punched to isolate distal ends of the power conductors 304, 306 without severing or interfering with the segment heater elements 310, 320, 322, 324, 326, 328.

For another example, electrical isolation of the distal ends 364, 366 of the power conductors 304, 306 of the power bus 302 can be provided by a distal end patch 374 as shown in FIG. 22. The distal end patch 374 can be, for example, a dielectric tape that is adhered onto the heater segment 300 over the distal ends 364, 366. For another example, electrical isolation of the distal ends 364, 366 of the power conductors 304, 306 of the power bus 302 can be provided by a dollop of dielectric or other electrically insulating adhesive (not shown) on the distal ends 364, 366.

The electrical isolation of the first and second power bus conductors 304, 306 from the segment heater elements 310, 312, 314, 316, 318 may not require the full interstitial isolation layer 340, especially where the part 342 of the segment heater elements 310, 312, 314, 316, 318 where the power conductors 304, 306 cross the segment heater elements 310, 312, 314, 316, 318 is small as shown in FIG. 19. Instead, such electrical isolation between the power conductors 304, 306 and the small part 342 could be provided by a small patch of dielectric material positioned between the first and second power bus conductors 304, 306 and the part 342 that is just large enough to provide the electrical isolation or any other convenient size if desired.

Heat sensors (not shown) can be formed or embedded along with the segment heater elements 310, 312, 314, 316, 318 on the dielectric heater substrate sheet 330 or along with the first and second power conductors 304, 306 of the power bus 302 on the dielectric interstitial layer 340 as will be understood by persons skilled in the art once they understand the principles of this example heater mat 300. A variety of heat sensor materials or devices (not shown) are known to persons skilled in the art and available commercially that can be affixed to any of the layers, e.g., the heater substrate sheet 330, the interstitial layer 340, or the outer isolation layer during the assembly process. Also, heat sensors can be affixed directly to the object, e.g., piping P (FIG. 1) being heated with any of the example heater mats.

Figure 23:
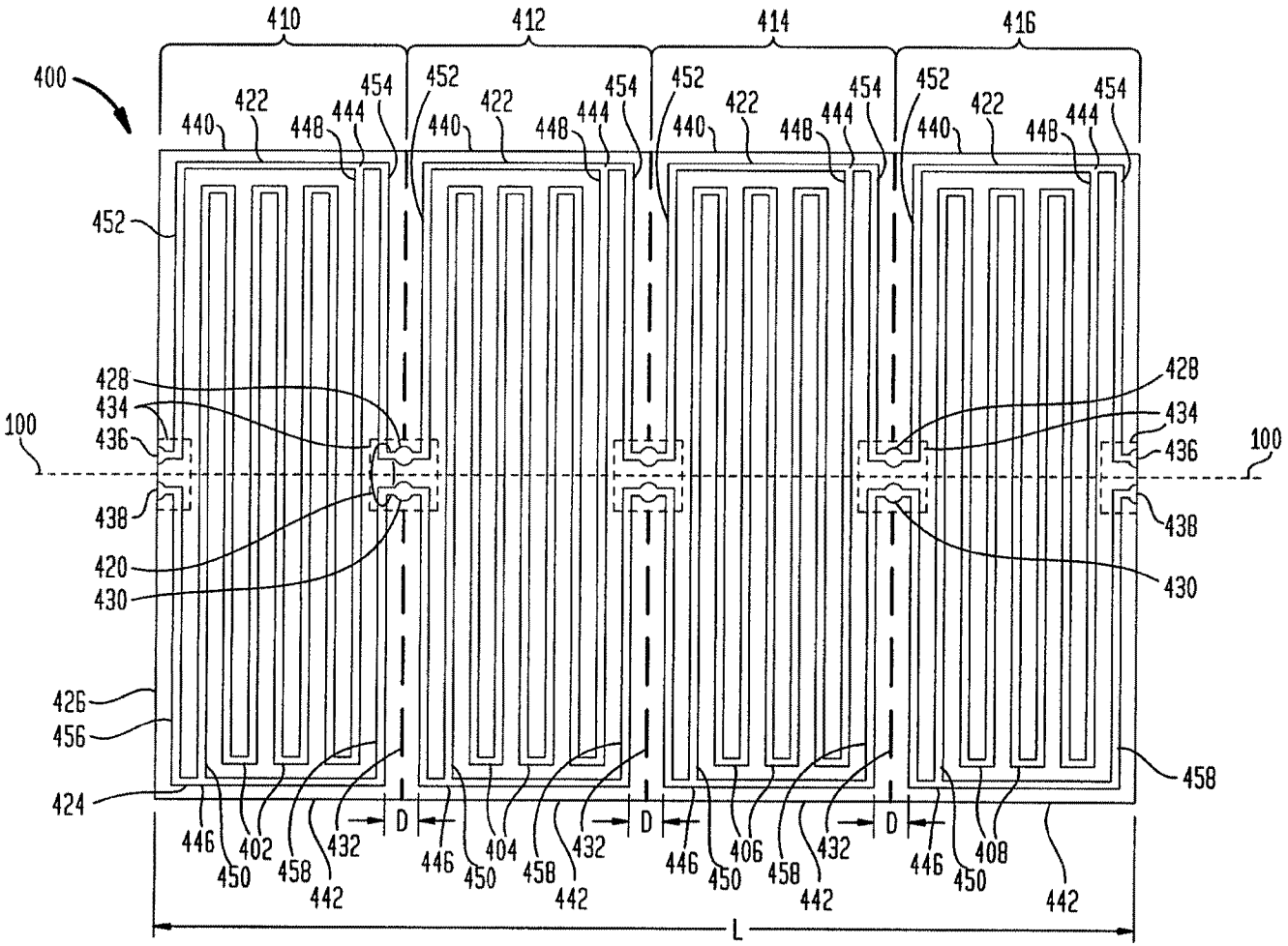
FIG. 23 is a top plan view of another example alternate heater mat showing the power conductors of the power bus integrated together with the heater elements of a plurality of heater segments on the same heater substrate sheet.

In another example embodiment heater mat 400 shown in FIG. 23, the segment heater elements 402, 404, 406, 408 of a plurality of heater mat segments, e.g., heater mat segments 410, 412, 414, 416, and the first and second power conductors 422, 424 of the power bus 420 are both positioned in juxtaposed relation with each other on the heater substrate sheet 426 in a manner such that neither of the power conductors 422, 424 cross any part of the segment heater elements 402, 404, 406, 408. Therefore, the first and second power conductors 422, 424 can be placed on the heater substrate sheet 426 in a unitary manner with the segment heater elements 402, 404, 406, 408, and there is no requirement for an interstitial layer to isolate the first and second power conductors 422, 424 from the segment heater elements 402, 404, 406, 408. Also, the first and second power conductors 422, 424 can comprise an electrically resistive metal, metal allow, ceramic, or polymer matrix load with conductive particles similar to the segment heater elements 402, 404, 406, 408, so that the first and second power conductors 422, 424 create heat when connected to a source of power (not shown) to function as supplemental heat producing elements that produce and contribute heat in the heater mat 300 in addition to the heat produced by the segment heater elements 402, 404, 406, 408.

In the FIG. 23 embodiment, the power conductors 422, 424 of the power bus 420 are positioned on laterally opposite sides 440, 442 of the heater mat segments 410, 412, 414, 416 with the respective segment heater elements 402, 404, 406, 408 positioned between the power conductors 422, 424 so that neither of the power conductors 422, 424 crosses or intersects the segment heater elements 402, 404, 406, 408 except at the first and second segment connection locations 444, 446 in the power bus 420 where the respective first and second opposite distal ends 448, 450 of the segment heater elements 402, 404, 406, 408 connect to the respective first and second power conductors 422, 424. First and second power plug connection pads 428, 430 in the respective power conductors 422, 424 can be provided at any convenient location to facilitate connection of a power cord (not shown) to the first and second power conductors 422, 424 of the power bus 420 at any one or more of such locations where the first and second plug connection pads 428, 430 are provided. One example convenient location for the first and second plug connection pads 428, 430 is in juxtaposed relation with each other along the longitudinal axis 100 to facilitate connection of the power plug (not shown) in a location along the longitudinal axis 100. Therefore, in the FIG. 23 example, the respective first and second power conductors 422, 424 of the power bus 420 have legs 452, 454 and 456, 458, respectively, along longitudinally opposite ends of the respective heater mat segments 410, 412, 414, 416 that route the power conductors to the plug connection pads 428, 430 in juxtaposed relation with the longitudinal axis 100 in the trimmable distances D between the segment heater elements 402, 404, 406, 408.

Since the first and second power conductors 422, 424 are connected in an integral manner with the segment heater elements 402, 404, 406, 408 on the same heater substrate sheet 426 with no interstitial layer required, as explained above, no other connection pads or connectors are needed to connect the segment heater elements 402, 404, 406, 408 to the first and second power conductors 422, 424. Heater mat segment boundary indicia 432 are provided on the heater mat 300 in alignment with the trimmable distances D for the same purposes as explained above for the heater mat boundary indicia described above for the other example heater mat embodiments 30 and 300. While no outer isolation layer or superstrate is shown in FIG. 23, such an outer isolation layer or superstrate sheet of dielectric or other electrically insulating material can be provided over the segment heater elements 402, 404, 406, 408 to sandwich the segment heater elements 402, 404, 406, 408 between the heater substrate sheet 426 and such superstrate sheet. Also, a thermal insulation layer is not shown on the heater mat 400 in FIG. 23, but a thermal insulation layer can be provided if desired. Also, punch zones 434 are zones or areas at which the heater mat 400 can be punched or cut to recess exposed distal ends 436, 438 of the first and second power conductors 422, 424 inwardly from the side edges of the heater mat 400 in a similar manner as the punch zones 370 of the heater mat 300 described above. Alternatively, a distal end patch (not shown) similar to the distal end patch 374 shown in FIG. 22 can be used for electrical isolation of the otherwise exposed distal ends 436, 438 of the power conductors 422, 424.

Heat sensors (not shown) can formed or embedded along with the segment heater elements 402, 404, 406, 408 on the heater substrate sheet 426. Also, heat sensors can be affixed directly to the object being heated, for example, to the piping P in FIG. 1) with any of the example heater mats 10, 10', 200, 300, and 400 described above.

Figure 24:
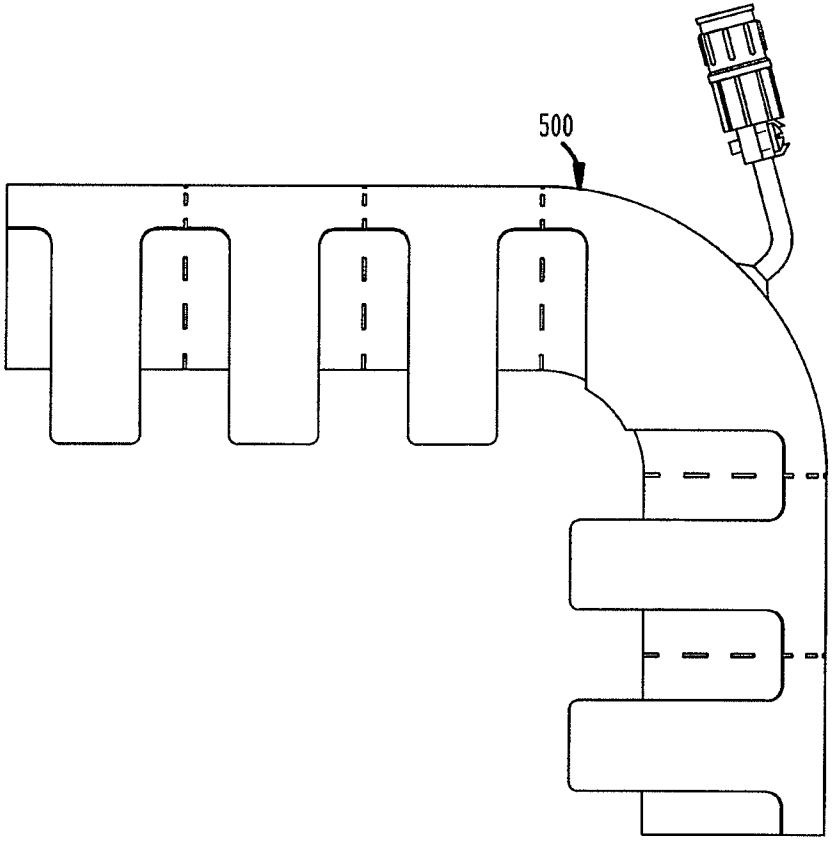
FIG. 24 is a side elevation view of an alternate embodiment trimmable heater appliance in a form shaped for mounting on a pipe elbow fitting.
Figure 25:
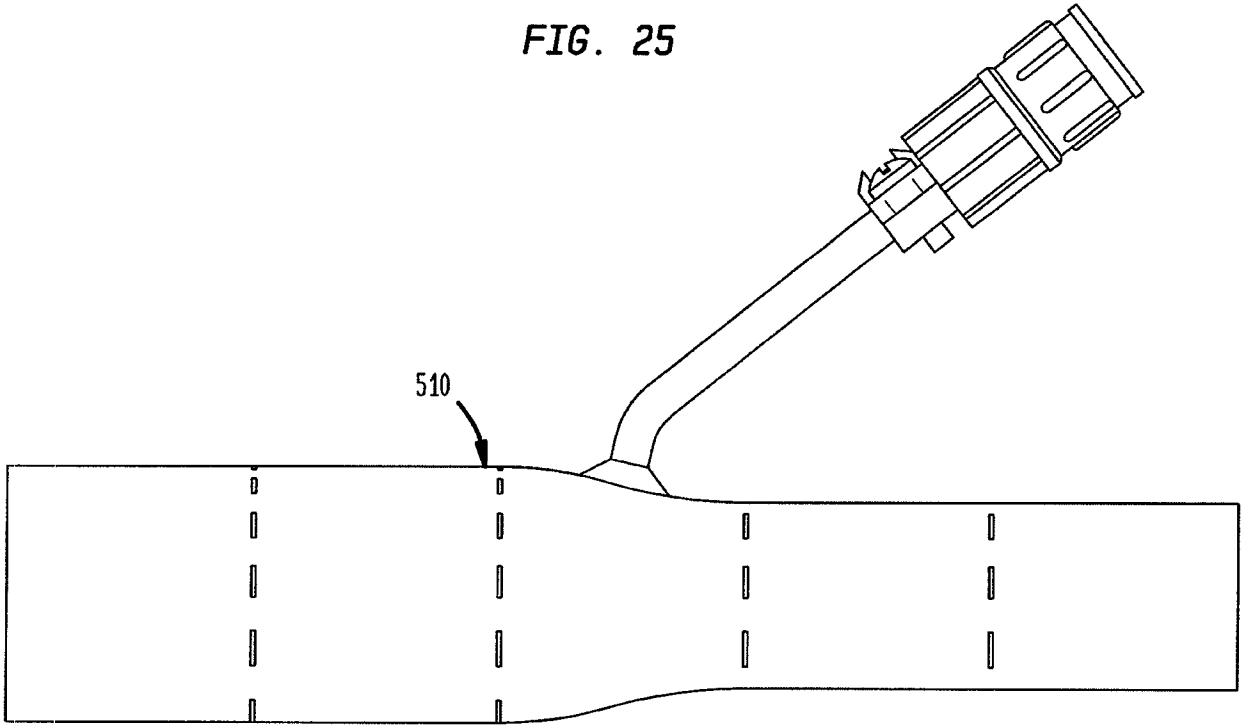
FIG. 25 is a side elevation view of an alternate embodiment trimmable heater appliance in a form shaped for mounting on a pipe reducer fitting.
Figure 26:
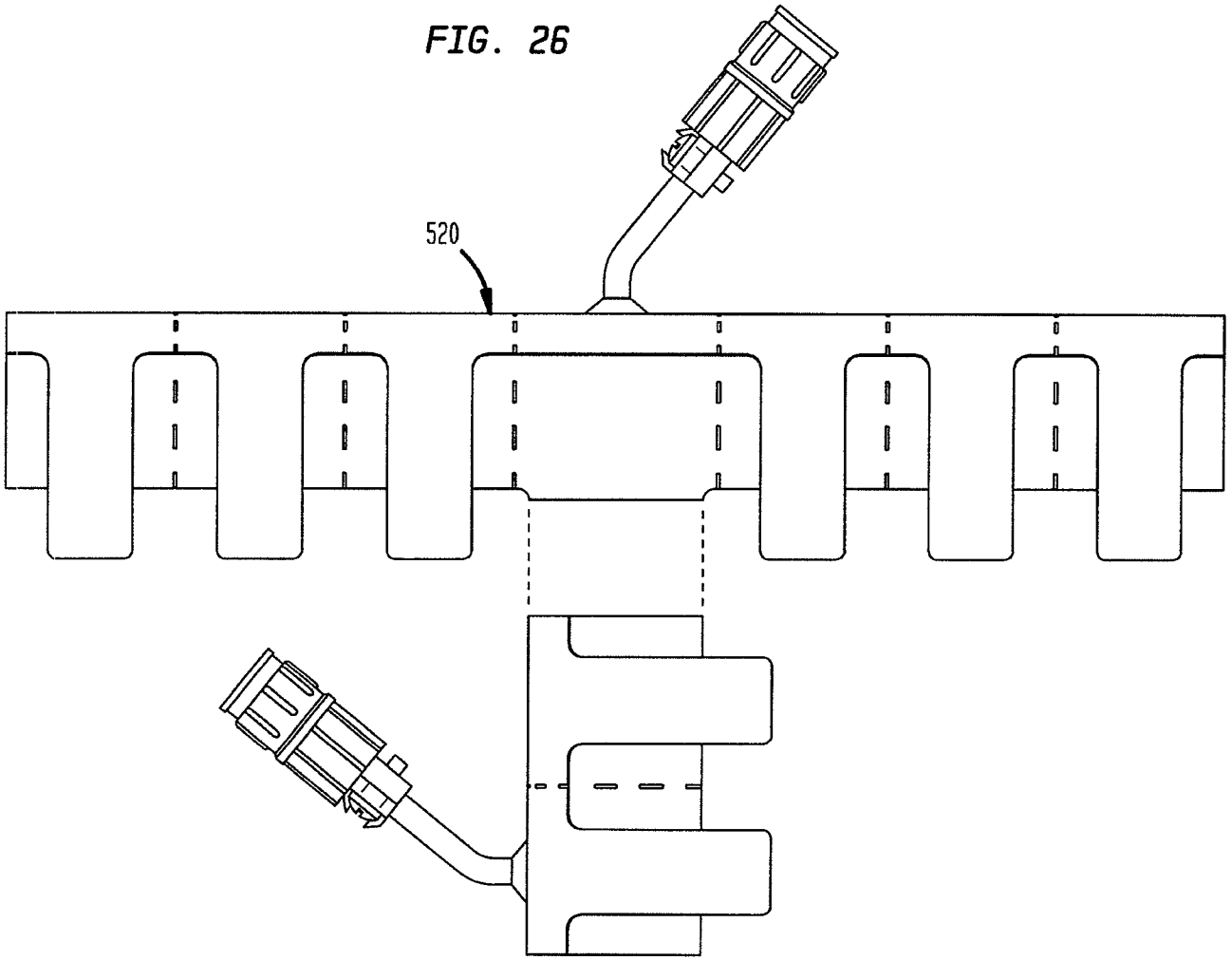
FIG. 26 is a side elevation view of an alternate embodiment trimmable heater appliance in a form shaped for mounting on a pipe Tee fitting.

The example trimmable heater appliances 10, 10', 200, 300, and 400 described above can also be provided in a variety of shapes for various applications. For example, the trimmable heater appliance 500 shown in FIG. 24 is shaped for heating elbow pipe fittings (not shown). The trimmable heater appliance 510 shown in FIG. 25 is shaped for heating reducer pipe fittings (not shown). The trimmable heater appliance 520 in FIG. 26 is shaped for heating Tee pipe fittings.

The foregoing description provides examples that illustrate the principles of the invention, which is defined by the features that follow. Since numerous insignificant modifications and changes will readily occur to those skilled in the art once they understand the invention, it is not desired to limit the invention to the exact example constructions and processes shown and described above. Accordingly, resort may be made to all suitable combinations, subcombinations, modifications, and equivalents that fall within the scope of the invention as defined by the features. The words "comprise," "comprises," "comprising," "include," "including," and "includes" when used in this specification, including the features, are intended to specify the presence of stated features, integers, components, or steps, but they do not preclude the presence or addition of one or more other features, integers, components, steps, or groups thereof. Also, directional terms, such as "upwardly", e.g., "upwardly extending", or "over" relate to orientation in the drawing sheets, not to any particular physical orientation or any limitation on orientation of the appliance or component in actual use.

The invention claimed is:

1. Trimmable heater apparatus, comprising:

a heater mat which extends along a longitudinal length and comprises a plurality of heater mat segments, wherein each of the heater mat segments extends along a respective portion of the longitudinal length of the heater mat, and wherein each of the heater mat segments comprises a segment heater element, and wherein the respective segment heater elements are separated longitudinally from each other by respective trimmable distances;

a power bus comprising a first power conductor and a second power conductor which span all of the trimmable distances between the segment heater elements to extend in juxtaposed relation with at least a portion of each of the heater mat segments, wherein each of the respective segment heater elements is connected electrically to the first and second power conductors at respective segment connection locations in the power bus that are in juxtaposed relation with the respective heater mat segments which comprise the respective segment heater elements such that any two of the plurality of heater mat segments are severable from each other in the trimmable distance between the segment heater elements of said two heater mat segments in a manner that does not affect the electrical connections of the segment heater element in at least one of the two heater mat segments to the first and second power conductors in the power bus;

a displaceable cover sheet overlaying the heater mat and overlaying the power bus, said cover sheet being displaceable in a manner that uncovers the power bus in the trimmable distance in which one of the heater mat segments is severed from another of the heater mat segments to accommodate trimming of exposed ends of the power bus and said cover sheet being replaceable over the power bus to cover and electrically isolate the trimmed ends of the power bus.

2. The trimmable heater apparatus of claim 1, including heater mat segment boundary indicia on a surface of the heater mat in each of the trimmable distances, wherein the heater mat segment boundary indicia mark severable locations on the heater mat in the trimmable distances.

3. The trimmable heater apparatus of claim 2, including bus trim location indicia on the power bus between the respective segment connection locations in the power bus.

4. The trimmable heater apparatus of claim 3, wherein the bus trim location indicia for each heater mat segment is longitudinally offset from the heater mat segment boundary indicia for that mat segment.

5. The trimmable heater apparatus of claim 2, wherein the cover sheet is peelable away from the heater mat segments to reveal the heater mat segment boundary indicia.

6. The trimmable heater apparatus of claim 3, wherein the cover sheet is peelable away from the power bus to reveal the bus trim location indicia.

7. The trimmable heater apparatus of claim 1, wherein the heater mat includes a thermal insulation layer positioned between the heater mat and the cover sheet.

8. The trimmable heater apparatus of claim 5, wherein the heater mat includes a thermal insulation layer positioned between the heater mat and the cover sheet, and the heater mat segment boundary indicia is on an exterior surface of the thermal insulation layer.

9. The trimmable heater apparatus of claim 8, wherein the power bus is positioned between the thermal insulation layer and the cover sheet.

10. The trimmable heater apparatus of claim 8, wherein the power bus is positioned between the segment heater elements and the thermal insulation layer.

11. The trimmable heater apparatus of claim 1, wherein the heater mat includes a heater substrate on which the segment heater elements are positioned.

12. The trimmable heater apparatus of claim 11, wherein the segment heater elements are sandwiched between the heater substrate and a heater superstrate.

13. The trimmable heater apparatus of claim 8, wherein the thermal insulation layer is positioned between the heater superstrate and the cover sheet.

14. The trimmable heater apparatus of claim 11, wherein the heater substrate comprises a thin film dielectric material.

15. The trimmable heater apparatus of claim 1, wherein the segment heater elements are placed on a heater substrate sheet.

16. The trimmable heater apparatus of claim 15, wherein the first and second power conductors of the power bus are placed on an interstitial isolation layer which is placed on the segment heater elements on the heater substrate sheet.

17. The trimmable heater apparatus of claim 1, wherein the first and second power conductors of the power bus are placed on the substrate sheet together with the segment heater elements.

18. A method of constructing a heater appliance, comprising:

with a plurality of heater mat segments, each of which heater mat segments has a segment heater element, assembled together as a heater mat in such a manner that there is a trimmable distance between the respective segment heater elements, connecting each respective one of the segment heater elements in electrical parallel relation to first and second power conductors in a power bus at respective segment connection locations of the power bus that are in juxtaposed relation with the respective heater mat segments in which such segment heater elements are positioned; and providing respective heater mat segment boundary indicia on a surface of the heater mat at each of the respective trimmable distances to mark severable locations at which any two of the plurality of heater mat segments are severable from each other in a manner that does not affect the electrical connections of the segment heater element in at least one of the two heater mat segments to the first and second power conductors in the power bus; and placing a displaceable cover sheet over the heater mat and over the power bus that is displaceable in a manner that uncovers the power bus in the trimmable distance and exposes the heater mat segment boundary indicia and the bus trim location indicia in a manner that is replaceable over the power bus to electrically isolate severed ends of the power bus after the power bus has been severed at the bus trim location indicia.

19. The method of claim 18, including providing respective bus trim location indicia on the power bus between the respective segment connection locations of the power bus to mark severable bus locations at which the power bus is severable along with a respective heater mat segment in a manner that does not affect the electrical connection of a juxtaposed heater mat segment from which the respective heater mat segment is severable.

20. The method of claim 19, including positioning the bus trim location indicia for each respective heater mat segment in a longitudinally offset relation to the respective heater mat segment boundary indicia.

21. The method of claim 20, including placing a thermal insulation layer between the segment heater elements and the power bus.

22. The method of claim 20, including placing the power bus in juxtaposed relation with the segment heater elements and placing a thermal insulation layer between the power bus and the displaceable cover sheet.

23. The method of claim 18, including placing the plurality of segment heater elements on a thin film dielectric material.

24. The method of claim 23, including forming the plurality of segment heater elements along with additional segment heater elements on a sheet of the thin film dielectric material.

25. The method of claim 24, including cutting a portion of the sheet of the thin film dielectric material on which the plurality of segment heater elements are formed to separate that portion of the sheet of the thin film dielectric material from other portions of the sheet of the thin film dielectric material on which the additional segment heater elements are formed.

26. A method of fitting a heater mat on an item to be heated, comprising:

determining a length of the item to be heated;

determining how many segments of the heater mat are required to span the length of the item to be heated;

locating a specific indication on a surface of the heater mat that marks a location on the heater mat where a segment of the heater mat, which is not required for the heater mat to span the length of the item to be heated, is severable from another segment of the heater mat, which is required to span the length of the item to be heated, without affecting an electrical connection of a power bus to a segment heater element in the segment of the heater mat that is required to span the length of the item to be heated; and at the specific indication, severing the segment of the heater mat that is not required to span the length of the item to be heated from the segment of the heater mat that is required to span the length of the item to be heated.

27. The method of claim 26, including severing the power bus at a location that does not affect the electrical connection of the power bus to the segment heater element in the segment of the heater mat that is required to span the length of the item to be heated.

28. The method of claim 27, including displacing a cover sheet that covers the heater mat and the power bus enough to expose the specific indication and thereby to facilitate the severing, at the specific indication, of the segment of the heater mat that is not required to span the length of the item to be heated from the segment of the heater mat that is required to span the length of the item to be heated.

29. The method of claim 28, including replacing the cover sheet on the segment of the heater mat that is required to span the length of the item to be heated after the severing of the segment of the heater mat that is not required to span the length of the item to be heated from the segment of the heater mat that is required to span the length of the item to be heated.

30. The trimmable heater apparatus of claim 1, including a power cord with a first cord wire and a second cord wire electrically connected respectively to the first power conductor and the second power conductor of the power bus at a location adjacent to one of the heater mat segments between two of the trimmable distances.

31. The trimmable heater apparatus of claim 30, including a first prong connected to and extending laterally from the first power conductor and a second prong connected to and extending laterally from the second power conductor in juxtaposed, spaced relation to each other at the location adjacent to one of the heater mat segments between the two trimmable distances, wherein the first and second cord wires are connected electrically to respective first and second prong sockets, and wherein the first prong protrudes into the first prong socket and the second prong protrudes into the second prong socket to provide the respective electrical connections of the first and second cord wires of the power cord to the first and second power conductors of the power bus so that the power cord extends laterally from the heater mat segment.

32. The trimmable heater apparatus of claim 1, wherein each of the respective segment heater elements is connected electrically to the first and second power conductors by a self-stripping tap connector.

33. A method of fitting a heater mat on an item to be heated, comprising:

determining how many segments of the heater mat are required to span a length of the item to be heated;

locating a specific location on the heater mat where a segment of the heater mat, which is not required for the heater mat to span the length of the item to be heated, is severable from another segment of the heater mat, which is required to span the length of the item to be heated, without affecting an electrical connection of a power bus to a segment heater element in the segment of the heater mat that is required to span the length of the item to be heated;

at the specific location, severing the segment of the heater mat that is not required from the segment of the heater mat that is required, including severing the power bus at a location that does not affect the electrical connection of the power bus to the segment heater element in the segment of the heater mat that is required;

either before or after the severing of the segment of the heater mat that is not required from the segment of the heater mat that is required, displacing a cover sheet that covers the power bus enough to uncover at least a portion of the power bus in the segment of the heater mat that is required;

trimming the power bus at a setback distance from the specific location by severing and removing an additional length of the power bus in the segment of the heater mat that is required to create severed ends of the power bus in the segment of the heater mat that is required; and covering and electrically isolating the severed ends of the power bus by replacing the cover sheet on the segment of the heater mat that is required.

* * * * *